US012065919B2

(12) United States Patent
Warner et al.

(10) Patent No.: US 12,065,919 B2
(45) Date of Patent: Aug. 20, 2024

(54) AUTOMATED DETECTION OF PLUG AND PERFORATE COMPLETIONS, WELLHEADS AND WELLSITE OPERATION STATUS

(71) Applicant: Cold Bore Technology Inc., Calgary (CA)

(72) Inventors: William Dean Warner, Maple Ridge (CA); Craig Anthony Bergmann, Calgary (CA); Nicolai Calin Pacurari, Calgary (CA); Hector Arturo Nunez, Calgary (CA)

(73) Assignee: Cold Bore Technology Inc., Calgary (CA)

( * ) Notice: Subject to any disclaimer, the term of this patent is extended or adjusted under 35 U.S.C. 154(b) by 8 days.

(21) Appl. No.: 17/747,827

(22) Filed: May 18, 2022

(65) Prior Publication Data

US 2022/0389800 A1 Dec. 8, 2022

Related U.S. Application Data

(63) Continuation of application No. PCT/CA2020/051611, filed on Nov. 25, 2020.
(Continued)

(51) Int. Cl.
*E21B 43/267* (2006.01)
*E21B 21/08* (2006.01)
*E21B 47/00* (2012.01)

(52) U.S. Cl.
CPC ..... *E21B 43/267* (2013.01); *E21B 21/08* (2013.01)

(58) Field of Classification Search
CPC ..... E21B 2200/20; E21B 47/00; E21B 47/14; E21B 47/18; E21B 41/0021;
(Continued)

(56) References Cited

U.S. PATENT DOCUMENTS 6,980,940 B1 12/2005 Gurpinar et al.
2006/0102346 A1 5/2006 Casey
(Continued)

FOREIGN PATENT DOCUMENTS

CA 2980549 A1 9/2016
CA 2858100 C 10/2018
(Continued)

OTHER PUBLICATIONS

Haustveit et al., "Monitoring the Pulse of a Well through Sealed Wellbore Pressure Monitoring, a Breakthrough Diagnostic with a Multi-Basin Case Study", Society of Petroleum Engineers, SPE-199731-MS, Feb. 2020.
(Continued)

*Primary Examiner* — Zakiya W Bates
(74) *Attorney, Agent, or Firm* — Todd A. Rattray; Oyen Wiggs Green & Mutala LLP

(57) ABSTRACT

Methods determine a state of a well and comprise: receiving a set of well operations data comprising at least some measured well operations data; determining the occurrence of a well operations event based on the received data; evaluating one or more possible state transitions from a current well operations state to one or more possible new well operations states, the current state and the possible new states selected from a configurable plurality of well operations states, wherein evaluating the one or more possible state transitions is based on the current state, the determined event and the received data and wherein evaluating the one or more possible state transitions comprises determining a confidence level associated with each of the possible new states; and determining one of the possible new states to be a new predicted well operations state according to whichever possible new state has a highest confidence level.

23 Claims, 16 Drawing Sheets

Related U.S. Application Data

(60) Provisional application No. 62/940,226, filed on Nov. 25, 2019.

(58) Field of Classification Search
CPC ..... E21B 47/008; E21B 47/04; E21B 49/005; E21B 47/06; E21B 43/267; E21B 21/08
See application file for complete search history.

(56) References Cited

U.S. PATENT DOCUMENTS

| | | | |
|---|---|---|---|
| 2009/0276156 | A1 | 11/2009 | Kragas et al. |
| 2013/0173167 | A1 | 7/2013 | Abitrabi et al. |

FOREIGN PATENT DOCUMENTS

| | | | | | |
|---|---|---|---|---|---|
| EP | 2565366 | A2 | | 3/2013 | |
| GB | 2429797 | B | | 9/2010 | |
| WO | 2015184437 | A2 | | 12/2015 | |
| WO | WO-2015184437 | A2 | * | 12/2015 | ..... E21B 34/02 |
| WO | 2016039773 | A1 | | 3/2016 | |
| WO | WO-2016039773 | A1 | * | 3/2016 | ..... E21B 33/068 |
| WO | 2016153502 | A1 | | 9/2016 | |

OTHER PUBLICATIONS

Coldbore, "What is SmartPAD? | ECR (Electronic Completions Recorder) | By Cold Bore Technology | Facebook", Apr. 4, 2019.

* cited by examiner

AUTOMATED DETECTION OF PLUG AND PERFORATE COMPLETIONS, WELLHEADS AND WELLSITE OPERATION STATUS

This application is a continuation of Patent Cooperation Treaty (PCT) application No. PCT/CA2020/051611 having an international filing date of 25 Nov. 2020, which in turn claims priority to, and the benefit under 35 USC 119 in connection with, U.S. application No. 62/940,226 filed 25 Nov. 2019. All of the applications discussed in this paragraph are hereby incorporated herein by reference.

TECHNICAL FIELD

The inventions relates to systems for monitoring the status of wellhead and wellsite operations, especially during completions operations such as fracking.

BACKGROUND

During oil well completions operations such as fracking, a series of operations are conducted on the well. Tools must be deployed within the wellhead, used, and removed. Fluids and entrained solids from various systems may be pumped down the wellhead, and various related fluids allowed to flow out at stages during the completion. Completions can be demanding in both time and attention. Completions can take multiple weeks of long hours to complete. The intensive nature of the work can mean that individuals may tire or lose focus. Errors or problems in the oil well completion process can cause expensive delays or even accidents risking injuries to personnel and damage to equipment. Oil well completions are also expensive processes due to the extensive combination of equipment, materials and personnel required. Each additional day of operation may add significant costs.

Existing systems of monitoring completions may involve several personnel manually measuring and/or reviewing the operational status of several systems or pieces of equipment. These measurements and/or monitoring observations are collected and checked against expectations for the given stage of the completions operation. These measurements and/or monitoring observations may be subject to errors in classification and timestamping, and may be subject to inconsistencies between individual field personnel. More errors may be introduced later in a completions operation as the attention and energy of the personnel wanes.

Accurate, efficient and comprehensive monitoring of completions operations can provide improvements in speed and efficiency by indicating that a given stage is complete and improving communication of that data. Additionally, when unexpected conditions or events occur on the site, accurate and prompt status updates may assist in restoring the operation.

There is a general desire to develop improved systems and methods for monitoring well site completions.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a method for determining an operational state of a well in a completion operation. The method comprises receiving a set of well operations data, the data comprising at least some measured well operations data and determining the occurrence of a well operations event based on the received data. After determining the occurrence of the event, the method comprises evaluating one or more possible state transitions from a current well operations state to one or more possible new well operations states, the current state and the possible new states selected from a configurable plurality of well states, wherein evaluating the one or more possible state transitions is based on the current state, the determined event and the received data. Evaluating the one or more possible state transitions comprises determining a confidence level associated with each of the possible new states. The method further comprises determining one of the possible new states to be a new predicted well operations state according to whichever possible new state has a highest confidence level.

In some embodiments, evaluating the one or more possible state transitions comprises selecting the one or more possible new states from among the plurality of well operations states based on the current states. In some embodiments, receiving the set of data comprises receiving measured valve position data from one or more valve position sensors, each valve position sensor measuring a position of a corresponding valve. Determining the occurrence of the event based on the received data may comprise determining from at least one of the one or more valve position sensors that its corresponding valve has transitioned from open to closed or from closed to open. The one or more valve position sensors may comprise a plurality of valve position sensors, wherein determining the occurrence of the event based on the received data comprises determining from a group of two or more of the plurality of valve position sensors that their corresponding valves have transitioned from open to closed or from closed to open.

In some embodiments, determining the occurrence of the event based on the received data comprises determining from at least one of the one or more valve position sensors that its corresponding valve is being greased. In some embodiments, evaluating the one or more possible state transitions from the current state to the one or more possible new states is based at least in part on the measured valve position data. Determining the confidence level associated with each of the possible new states may be based at least in part on the measured valve position data.

In some embodiments, receiving the set of data comprises receiving measured pressure data from one or more pressure sensors, each pressure sensor measuring pressure in a corresponding region of the well. Determining the occurrence of the event based on the received data may comprise determining that the pressure measured by at least one of the one or more pressure sensors has crossed from above a configurable threshold to below the configurable threshold or from below the configurable threshold to above the configurable threshold. Evaluating the one or more possible state transitions from the current state to the one or more possible new states may be based at least in part on the measured pressure data. In some embodiments, determining the confidence level associated with each of the possible new states is based at least in part on the measured pressure data.

In some embodiments, receiving the set of data comprises receiving $3^{rd}$ party data (e.g. generated by the well operator or another party performing operations at the wellsite) and evaluating the one or more possible state transitions from the current state to the one or more possible new states is based at least in part on the $3^{rd}$ party data. The confidence level associated with each of the possible new states may be based at least in part on the $3^{rd}$ party data. In some embodiments, evaluating the one or more possible state transitions from the current state to the one or more possible new states is based at least in part on topology data relating to a spatial relationship between the well, the one or more valve position sensors and the one or more pressure sensors.

In some embodiments, the configurable plurality of states comprises: well shut in—waiting for wireline; well shut in—waiting for frac; wireline swapover; wirelines plug & perforate; frac swapover; and frac. In some embodiments, determining the occurrence of the event comprises one or more of: determining that a flow rate from a frac pumping provider has crossed a configurable frac-pump threshold; determining that a flow rate from a pump down pumping provider has crossed a configurable pump-down threshold; determining that a proppant concentration has crossed a configurable proppant-concentration threshold; and determining that a total cumulative amount (e.g. weight) of proppant for a current completion stage has crossed a configurable proppant-volume threshold.

In some embodiments, determining the occurrence of the event comprises determining that the current state has ben unchanged for more than a configurable time threshold or that a configurable time threshold has expired since a determination of a preceding event. A duration of the configurable time threshold may be dependent on the current state or on a preceding detected event. In some embodiments, the configurable pressure threshold is based at least on an expected nominal pressure of a wellbore associated with the well at a current stage of completion.

In some embodiments, determining that the pressure measured by at least one of the one or more pressure sensors has crossed from above the configurable threshold to below the configurable threshold or from below the configurable threshold to above the configurable threshold comprises: detecting that the pressure has crossed the configurable threshold at a first time from an initial pressure state to a first new pressure state based on data received from the at least one of the one or more pressure sensors; monitoring the pressure measured by the at least one of the one or more pressure sensors for a dwell time period after the first time; and concluding that the pressure has crossed from above the configurable threshold to below the configurable threshold or from below the configurable threshold to above the configurable threshold if the pressure does not re-cross the configurable threshold during the dwell time period after the first time. Determining that the pressure measured by at least one of the one or more pressure sensors has crossed from above the configurable threshold to below the configurable threshold or from below the configurable threshold to above the configurable threshold may comprise determining the pressure measured by at least one of the one or more pressure sensors to have crossed from above the configurable threshold to below the configurable threshold or from below the configurable threshold to above the configurable threshold at the first time. Determining that the pressure measured by at least one of the one or more pressure sensors has crossed from above the configurable threshold to below the configurable threshold or from below the configurable threshold to above the configurable threshold may comprise determining the pressure measured by at least one of the one or more pressure sensors to have crossed from above the configurable threshold to below the configurable threshold or from below the configurable threshold to above the configurable threshold at a most recent time that the pressure crosses the configurable threshold.

The dwell time period may be based on an expected water hammer echo period associated with the well. The dwell time period may be greater than the expected water hammer echo period.

The method may comprise establishing a plurality of configurable pressure thresholds. Determining the occurrence of the event based on the received data may comprise at least one of: determining that the pressure measured by at least one of the one or more pressure sensors has crossed from above one of the plurality of configurable thresholds to below the one of the plurality of configurable thresholds or from below the one of the plurality of configurable thresholds to above the one of the plurality of configurable thresholds; and determining that the pressure measured by at least one of the one or more pressure sensors has crossed from above one of the plurality of configurable thresholds to below a different one of the plurality of configurable thresholds or from below one of the plurality of configurable thresholds to above a different one of the plurality of configurable thresholds.

Determining the confidence level associated with each of the possible new states may comprise, for each of the possible new states, assigning the possible new state a confidence level selected from among a plurality of possible confidence levels. A number of the plurality of possible confidence levels may be less than or equal to 10. A number of the plurality of possible confidence levels may be three: high, medium and low.

Determining one of the possible new states to be the new predicted well operations state may comprise determining that there are two or more of the possible new states with equally high confidence levels and applying tie-breaking criteria between the two or more of the possible new states to select the one of the two or more of the possible new states to be the new predicted state. The tie-breaking criteria may be based on at least one of the current state, the determined event and received data. The received data may comprise 3rd party data (e.g. generated by the well operator or another party performing operations at the wellsite) and the tie-breaking criteria may be based at least in part on the 3rd party data. The method may comprise obtaining topology data relating to a spatial relationship between the well, the one or more valve position sensors and the one or more pressure sensors and the tie-breaking criteria may be based at least in part on the topology data. Determining one of the possible new states to be the new predicted well operations state may comprise determining that there are two or more of the possible new states with equally high confidence levels and presenting the two or more of the possible new states to an operator to select the one of the two or more of the possible new states to be the new predicted state.

Evaluating the one or more possible state transitions may comprise: selecting the one or more possible new states from among the plurality of well operations states based on the current state and the determined event; for each of the one or more possible new states: using the received data to evaluate one or more configurable conditions; and if the one or more configurable conditions are met, assigning a corresponding confidence level to the possible new state. Using the received data to evaluate one or more configurable conditions may comprise using the measured data to evaluate the one or more configurable conditions. The received data may comprise 3rd party data (e.g. generated by the well operator or another party performing operations at the wellsite) and using the received data to evaluate one or more configurable conditions may comprise using the 3rd party data to evaluate the one or more configurable conditions. The method may comprise obtaining topology data relating to a spatial relationship between the well, the one or more valve position sensors and the one or more pressure sensors and using the topology data to evaluate the one or more configurable conditions Evaluating the one or more possible state transitions may comprise: grouping the one or more valves into valve groups, each valve group comprising one or more valves and associated with one or more corresponding valve position sensors; constructing a vector, with entries for each valve group based on the measured valve position data from its associated valve position sensors; comparing the constructed vector with each row of a secondary analysis matrix, each row of the secondary analysis matrix corresponding to one of the configurable plurality of states and each column of the secondary analysis matrix corresponding to one of the valve groups, wherein each element of the secondary analysis matrix comprises an assigned numerical value based on an expected state of that valve group (column) for that one of the configurable plurality of states (row); assigning a ranking to the configurable plurality of states based on the comparing of the constructed vector with each row of the secondary analysis matrix. Assigning the ranking to the configurable plurality of states based on the comparing of the constructed vector with each row of the secondary analysis matrix may comprise: for each of the configurable plurality of states, assigning a relatively high confidence level to the state if a difference between the constructed vector and the row element of the secondary analysis matrix corresponding to the state is relatively low and assigning a relatively low confidence level to the state if the difference between the constructed vector and the row element of the secondary analysis matrix corresponding to the state is relatively high; and ranking the configurable plurality of states based on confidence level.

Evaluating the one or more possible state transitions may comprise: grouping the one or more valves into valve groups, each valve group comprising one or more valves and associated with one or more corresponding valve position sensors; grouping the one or more pressure sensors into pressure sensor groups, each pressure sensor group comprising one or more pressure sensors; constructing a vector, with entries for each valve group based on the measured valve position data from its associated valve position sensors and for each pressure sensor group based on measured pressure sensor data from its associated pressure sensors; comparing the constructed vector with each row of a secondary analysis matrix, each row of the secondary analysis matrix corresponding to one of the configurable plurality of states and each column of the secondary analysis matrix corresponding to one of the valve groups or one of the pressure sensor groups, wherein each element of the secondary analysis matrix comprises an assigned numerical value based on an expected state of that valve group or that pressure sensor group (column) for that one of the configurable plurality of states (row); assigning a ranking to the configurable plurality of states based on the comparing of the constructed vector with each row of the secondary analysis matrix. Assigning the ranking to the configurable plurality of states based on the comparing of the constructed vector with each row of the secondary analysis matrix may comprise: for each of the configurable plurality of states, assigning a relatively high confidence level to the state if a difference between the constructed vector and the row element of the secondary analysis matrix corresponding to the state is relatively low and assigning a relatively low confidence level to the state if the difference between the constructed vector and the row element of the secondary analysis matrix corresponding to the state is relatively high; and ranking the configurable plurality of states based on confidence level.

Evaluating the one or more possible state transitions may comprise: grouping the one or more valves into valve groups, each valve group comprising one or more valves and associated with one or more corresponding valve position sensors; assigning numerical valves to each valve group based on the measured valve position data from its associated valve position sensors; constructing a vector, with entries for each valve group corresponding the assigned numerical value for that valve group; determining a difference metric between the constructed vector and each row of a secondary analysis matrix, each row of the secondary analysis matrix corresponding to one of the configurable plurality of states and each column of the secondary analysis matrix corresponding to one of the valve groups, wherein each element of the secondary analysis matrix comprises an assigned numerical value based on an expected state of that valve group (column) for that one of the configurable plurality of states (row); and assigning a ranking to the configurable plurality of states based on the difference metrics. Assigning the ranking to the configurable plurality of states based on the difference metrics may comprise: for each of the configurable plurality of states, assigning a relatively high confidence level to the state if a difference metric between the constructed vector and the row element of the secondary analysis matrix corresponding to the state is relatively low and assigning a relatively low confidence level to the state if the difference metric between the constructed vector and the row element of the secondary analysis matrix corresponding to the state is relatively high; and ranking the configurable plurality of states based on confidence level.

Evaluating the one or more possible state transitions may comprise: grouping the one or more valves into valve groups, each valve group comprising one or more valves and associated with one or more corresponding valve position sensors; grouping the one or more pressure sensors into pressure sensor groups, each pressure sensor group comprising one or more pressure sensors; assigning numerical valves to each valve group based on the measured valve position data from its associated valve position sensors and to each pressure sensor group based on the measured pressure data from its associated pressure sensors; constructing a vector, with entries for each valve group based on the assigned numerical value for that valve group and for each pressure sensor group based on assigned numerical value for that pressure sensor group; determining a difference metric between the constructed vector and each row of a secondary analysis matrix, each row of the secondary analysis matrix corresponding to one of the configurable plurality of states and each column of the secondary analysis matrix corresponding to one of the valve groups or one of the pressure sensor groups, wherein each element of the secondary analysis matrix comprises an assigned numerical value based on an expected state of that valve group or pressure sensor group (column) for that one of the configurable plurality of states (row); and assigning a ranking to the configurable plurality of states based on the difference metrics. Assigning the ranking to the configurable plurality of states based on the difference metrics may comprise: for each of the configurable plurality of states, assigning a relatively high confidence level to the state if a difference metric between the constructed vector and the row element of the secondary analysis matrix corresponding to the state is relatively low and assigning a relatively low confidence level to the state if the difference metric between the constructed vector and the row element of the secondary analysis matrix corresponding to the state is relatively high; and ranking the configurable plurality of states based on confidence level.

The method may comprise outputting the new predicted state.

Another aspect of the invention provides a method for determining operational states of a plurality of wells of a wellsite in a multi-well completion operation, the method comprising: performing a single well state prediction method for each of the plurality of wells to thereby predict an initial well operations state for each of the plurality of wells, the single well state prediction method comprising the method of any one of claims 1 to 50; after performing the single well state prediction method for all of the plurality of wells, for each of the plurality of wells: determining whether the predicted initial state of the well should be replaced with an updated well operations state prediction; if the determination determines that the predicted initial state of the well should be replaced with an updated state prediction, then replacing the predicted initial state of the well with the updated state prediction.

For each of the plurality of wells, determining whether the predicted initial state of the well should be replaced with the updated state prediction may comprise inferring the updated state prediction based at least in part on current states of one or more other wells from among the plurality of wells. For each of the plurality of wells, determining whether the predicted initial state of the well should be replaced with the updated state prediction may comprise inferring the updated state prediction based at least in part on determined events of the one or more other wells from among the plurality of wells. For each of the plurality of wells, determining whether the predicted initial state of the well should be replaced with the updated state prediction may comprise inferring the updated state prediction based at least in part on received data of the one or more other wells from among the plurality of wells. For each of the plurality of wells, determining whether the predicted initial state of the well should be replaced with the updated state prediction may comprise inferring the updated state prediction based at least in part on measured data of the one or more other wells from among the plurality of wells.

Performing the single well state prediction method for each of the plurality of wells may comprise determining that a resource associated with the wellsite is free and wherein, for each of the plurality of wells, determining whether the predicted initial state of the well should be replaced with the updated state prediction comprises inferring the updated state prediction based at least in part on the determination that the resource is free. The resource may comprise one or more of; a frac crew; a wireline crew; and a pump-down crew The method may comprise after inferring the updated state prediction based at least in part on the determination that the resource is free, updating a resource availability indication to indicate that the resource is no longer free.

Performing the single well state prediction method for each of the plurality of wells may comprise determining that a frac or wireline operation of one of the wells has completed and updating a corresponding schedule and wherein, for each of the plurality of wells, determining whether the predicted initial state of the well should be replaced with the updated state prediction comprises inferring the updated state prediction based at least in part on the updated schedule. The method may comprise after inferring the updated state prediction based at least in part on the updated schedule, further updating the updated schedule.

The method may comprise, after performing the single well state prediction method for all of the plurality of wells, validating the initial well operations state for each of the plurality of wells based on one or more of: current states of the plurality of wells; determined events of the plurality of wells; and received data of the plurality of wells. Validating the initial well operations state for each of the plurality of wells may be based on one or more of: sequence rules set by an operator of the wellsite; safety rules set by the operator of the wellsite; availability of one or more resources; a completion operations schedule of the wells; 3rd party data for any of the wells; configuration parameters relating to any of the wells. Validating the initial well operations state for each of the plurality of wells may comprise the evaluation of conflict rules, the conflict rules indicating whether a particular well state is to be present in only a single well from among the plurality of wells at a given time, wherein if conflicting states are determined at two or more wells, the method comprises accepting the initial well operations state at the well with the highest confidence level and rejecting the conflicting determination at the other wells. Validating the initial well operations state for each of the plurality of wells may determine that the initial well operations state for at least one well is invalid and the method may comprise one or more of: resetting the state of the at least one well to a most recent valid state; and seeking operator feedback.

The method may comprise determining the operational states of the plurality of wells of the wellsite in the multi-well completion operation at a plurality of execution instances. If a user override is applied to a state determination at one or more wells from a previous execution instance, the method may comprise determining the operational states of the plurality of wells of the wellsite in the multi-well completion operation at the previous execution instance and at all intervening execution instances up to a current execution instance.

The method may comprise instructing a crew to not approach a well until the determination of a state transition at another well.

Another aspect of the invention provides a system comprising a processor configured to perform any of the methods described herein.

Another aspect of the invention provides a method for determining a pressure anomaly at a well in a completion operation, the method comprising: receiving pressure data from the one or more pressure sensors; monitoring the pressure data over a plurality of reference time windows, each of the plurality of reference time windows separated from temporally adjacent ones of the plurality of reference time windows by a corresponding delay period; and fitting the received pressure data from a first one of the plurality of reference time windows to a reference model curve to thereby obtain a first set of model parameters; fitting the received pressure data from a second one of the plurality of reference time windows to the reference model curve to thereby obtain a second set of model parameters; determining a difference between one or more of the parameters of the first and second sets of model parameters; and determining an existence of a pressure anomaly where the difference is greater than a configurable pressure anomaly threshold.

Another aspect of the invention provides a method for determining a pressure anomaly at a well in a completion operation, the method comprising: receiving pressure data from the one or more pressure sensors; monitoring the pressure data over a first reference time window; and fitting the received pressure data from the first reference time windows to a reference model curve to thereby obtain a first set of model parameters; determining: a first predicted pressure at a specific time after, and temporally spaced apart from, the first time window using the first set of model parameters; a second pressure at the specific time; and a difference between the first predicted pressure and the second pressure; and determining an existence of a pressure anomaly where the difference is greater than a configurable pressure anomaly threshold.

Another aspect of the invention provides a method for determining the state of a completion operation, the method comprising receiving a set of measured wellsite operations parameters, evaluating a historical state of the wellsite and a set of alternative states of the wellsite against the set of measured wellsite operations parameters to determine a confidence level in each of the historical state of the wellsite and the alternative states of the wellsite, and setting a detected state of the wellsite as the historical state or one of the alternative states according to whichever had a higher confidence level.

In some embodiments: the one or more alternative states of the wellsite may be selected from a set of potential wellsite operations transitions based on the historical state of the wellsite; a set of measured wellsite operations parameters comprises receiving data from one or more valve positions sensors and/or pressure sensors, and the method further comprises the step of interpreting the set of measured wellsite operations parameters to determine a set of current states of one or more pieces of wellsite equipment or of a wellsite system; evaluating the historical state of the wellsite and a set of alternative states of the wellsite comprises, for each state, comparing the set of current states against a table of anticipated statuses for potential state transitions.

Another aspect of the invention provides a method for determining the state of a completions operation, the method comprising: receiving a set of measured wellsite operations parameters; evaluating a historical state of the wellsite and a set of alternative states of the wellsite against the set of measured wellsite operations parameters to determine a confidence level in each of the historical state of the wellsite and the alternative states of the wellsite; evaluating whether the confidence level in the historical state of the wellsite and the confidence levels in the one or more alternative states of the wellsite are less than a threshold confidence value; and evaluating a probability matrix against a vector representing a numerical representation of a set of the wellsite operations parameters to determine a probability value for each of several possible states of the wellsite.

A further aspect of the invention provides a detection system for detecting the current state of a completions operation, the detection system comprising: one or more groups of valve position sensors, each group of sensors comprising one or more valve position sensors; one or more pressure sensors; a primary analyzer, the primary analyzer connected to each of the groups of valve position sensors and the pressure sensors to receive sensor data and configured to determine, from the sensor data and a prior state of the completions operation, a probability that the completions operation has entered a new state, and evaluate from that probability the current state of the completions operation.

In some embodiments, the methods and systems may additionally or alternatively make use of other information for assessing the state of a completions operation. By way of non-limiting example, such other information may comprise $3^{rd}$ party data, such a proppant concentration, volumetric pumping rate (from a frac pumping provider and/or a pump-down pumping provider) and/or the like.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
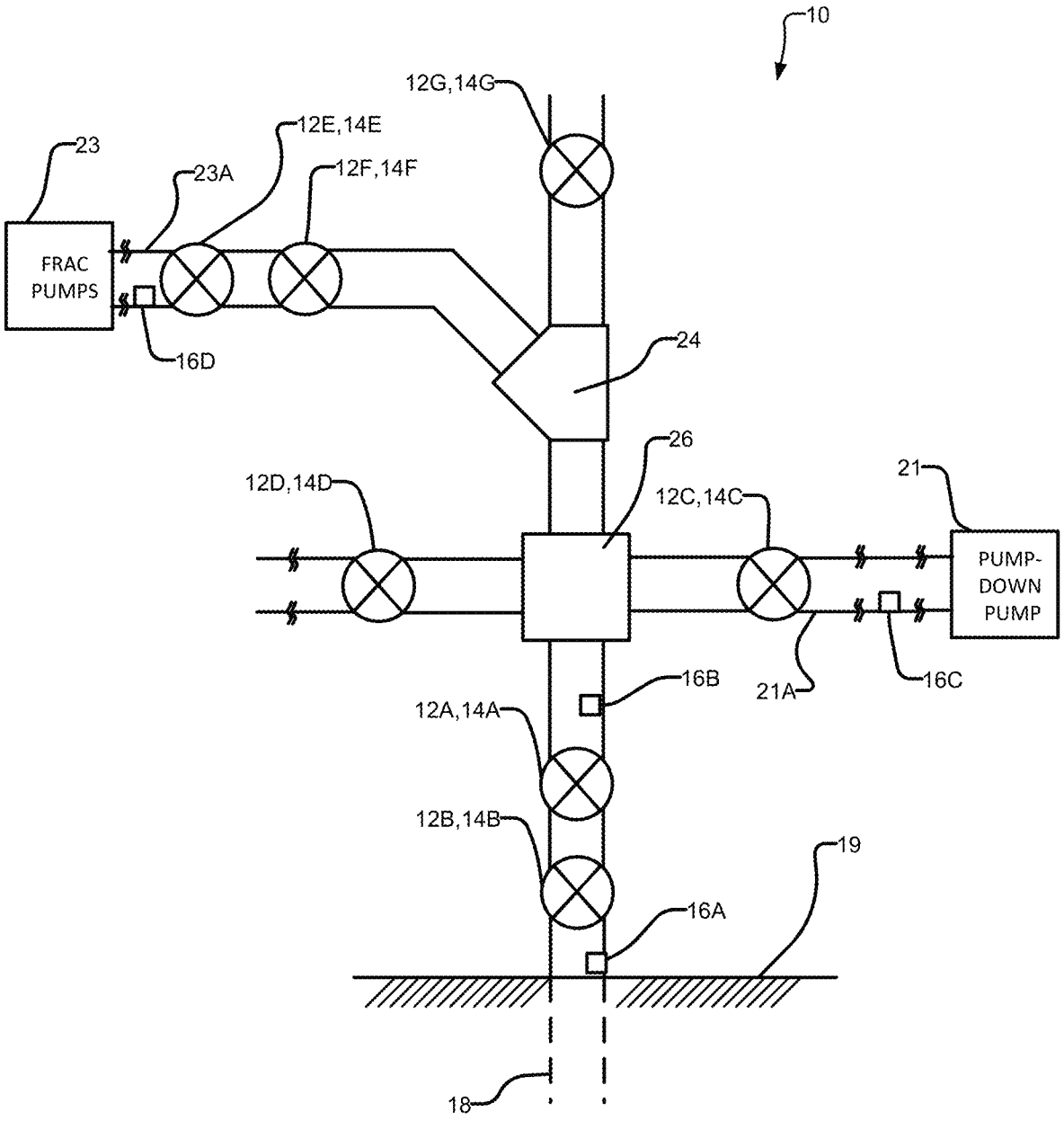
FIG. 1 is a diagram schematically depicting a generic fracking wellhead.

FIG. 1 depicts an exemplary generic fracking wellhead 10 (also known as a 'Christmas Tree') having multiple valves 12A, 12B, 12C, 12D, 12E, 12F, 12G (collectively, valves 12). each valve 12 monitored with a corresponding valve position sensor 14A, 14B, 14C, 14D, 14E, 14F, 14G (collectively, valve position sensors 14 or VPSs 14). Wellhead 10 further comprises multiple pressure transducers 16A, 16B, 16C, 16D (collectively, referred to as pressure transducers 16 or pressure sensors 16) in a number of locations. It will be appreciated that other well setups different from this generic setup are possible. It is also possible that the distribution of sensors and types of sensors used may be different. For example, some wellheads may not support pressure monitoring at all of the illustrated locations. Some wellheads may employ valves which are not easily monitored by valve position sensors. Yet another possibility is that piping may be manually re-arranged between different activities instead of having a valve arrangement. Such cases may be viewed, for example, as a circumstance similar to those in which a valve normally being at that connection point is not being monitored.

In the example of wellhead 10, there are multiple different pressure sensors 16 and sets of valves 12. There are a plurality (e.g. 2) of master valves, identified as the upper master valve 12A and lower master valve 12B, monitored by valve position sensors (VPS) 14A and 14B, respectively. Master valves 12A and 12B are used to isolate the underground wellbore 18 (i.e. the portion of the well below the ground surface 19) from surface piping and equipment. The pump-down valve 12C (often just one valve), monitored by a corresponding VPS 14C, connects a pump-down pump 21, often via a manifold 21A, to the rest of wellhead 10. Pump-down pump 21 may be used to push a 'plug and perforation' tool into position downhole, pump acid downhole as needed, and assorted other functions.

Flow-back valve 12D (often just one valve), monitored by a corresponding VPS 14D, can be opened as needed to allow release (flow-back) of fluid from the downhole wellbore 18 during fracking operations and/or other completions operations.

Frac valves 12E and 12F (often a plurality (e.g. 2) of valves, sometimes referred to as "zipper" valves), monitored by corresponding VPS 14E and 14F, connect a plurality of high-pressure frac pumps 23, often via a manifold 23A, to the rest of wellhead 10. Frac pumps 23 provide the high pressure proppant (typically a mixture of water, sand and other chemicals) needed to fracture the underground formation. Furthermore, frac pumps 23 provide the volumetric flow to transport the proppant to each successive frac zone.

Swab valve 12G (often just one valve), monitored by corresponding VPS 14G, provides an entry into wellbore 18 for a 'plug and perforation' tool which may be repeatedly deployed to prepare a downhole section of wellbore 18 for fracking. As needed, a coil tube tool and/or other tools can additionally or alternatively be deployed downhole through swab valve 12G.

When multiple valves 12 in a group are present (e.g., upper master and lower master valves 12A and 12B), it is common for them to be arranged in series, such that the valve group is effectively closed if any individual valves 12 in the group are closed. Likewise, the valve group is open only when all individual valves 12 in that group are open. It is also possible for valves 12 in a group to be arranged in parallel. For example, a frac valve group (e.g. valves 12E and 12F) could have two valves 12 independently connecting frac pumps 23 to the rest of wellhead 10 such that the group is effectively open if any valve 12 in the group is open and closed only if all valves 12 in the group are closed.

Wellhead 10 comprises a pressure transducer 16A which measures the pressure in the downhole wellbore 18. Wellhead 10 further comprises pressure transducer 16B which measures the pressure in the wellhead 10. In the illustrated embodiment, when both master valves 12A and 12B are open, the wellhead pressure transducer 16B senses the same approximate pressure as the wellbore pressure transducer 16A. Wellhead 10 also comprises pressure transducer 16C for measuring the pressure in pump-down manifold 21A. Similarly, pressure transducer 16D may be provided to measure the pressure in frac manifold 23A.

Wellhead 10 of the illustrated embodiment comprises a pipe joint 24 commonly referred to as a "buffalo head" which connects frac manifold 23A and the swab manifold to the main downhole wellbore 18 and a second pipe joint 26 commonly referred to as a "flow cross" which connects pump down manifold 21A and the flow back manifold to the main wellbore 18. In general, wellhead 10 may comprise any suitable number and/or types of pipe joints, which may comprise permanent joints and/or configurable couplings.

Generally, for any given wellhead at each pipe input or output to or from the wellhead, it is possible to provide a group of one or more valves arranged in parallel or in series. Each of these valves may comprise corresponding VPS for monitoring the status of the valves. Pressure transducers may further be provided at one or both ends of each group of valves or at any other suitable location(s) for monitoring the pressure at various important points of the wellhead.

Figure 2:
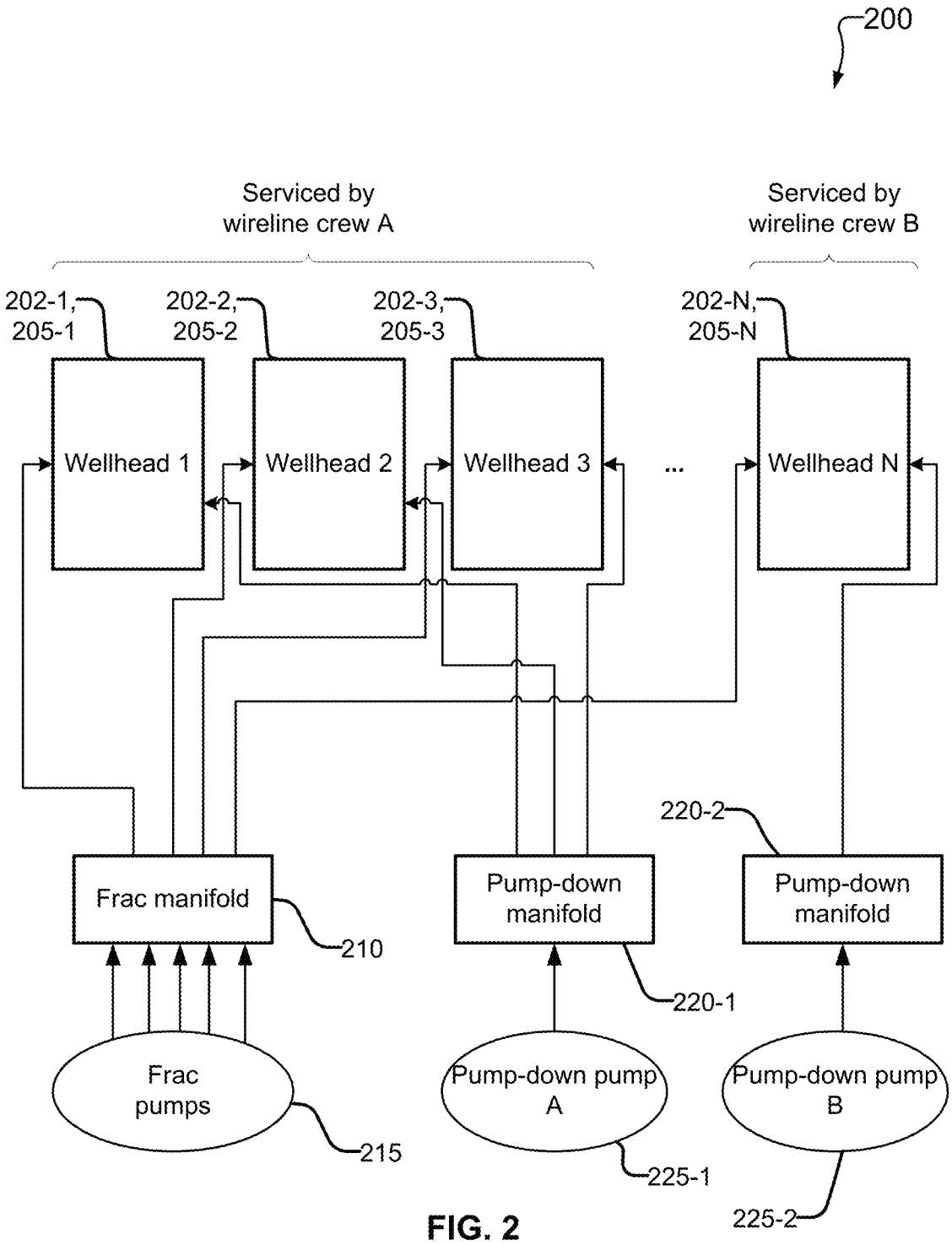
FIG. 2 is a chart schematically depicting connections between frac pumps, well heads and pump-down pumps and how these may be divided between one or more wireline crews.

FIG. 2 depicts an example multi-well completions configuration 200 in which multiple wells 202-1, 202-2, 202-3, . . . 202-N (collectively, wells 202) are being fracked using plug & perf methods. Each of the FIG. 2 wells 202 is associated with a corresponding wellhead 205-1, 205-2, 205-3, . . . 205-N (collectively, wellheads 205), which may have characteristics and/or features similar to those of the FIG. 1 wellhead 10. In the FIG. 2 illustration, all of wellheads 205 are connected to a single frac manifold 210 which is in turn connected to frac pumps 215.

Depending on the number of wells being fracked, one or more wireline crews may be used. The wireline crew(s) may be responsible for deploying the "plug & perf" tool (not expressly shown in FIG. 2) downhole on each well. In the case of the FIG. 2 example, there are two wireline crews—wireline crew A services wells 202-1, 202-2, 202-3 and wireline crew B services well 202-N. Each of the wells 202 serviced by a single wireline crew has their own pump-down manifold 220 (shown as manifolds 220-1 and 220-2), each of which is connected to a corresponding pump-down pump 225 (shown as pump-down pumps 225-1 and 225-2). In other embodiments, all of the wellheads 205 may share a single pump-down pump 225. It is common for a wireline crew to service up to 3 wells 202, and for multiple crews to be used when more than 3 wells are being operated upon. However, the actual number of wireline crews used can vary and may be site and/or operator dependent. In some operations with multiple wells and multiple wireline crews, the wells may be separated into groups in which each group may be serviced by a single wireline crew or by more than one wireline crew. For example, consider a 5-well operation with two wireline crews. Two of the wells might be serviced by only one of the two wireline crews, another two of the wells might be serviced by only the other of the two wireline crews, but the last well might be serviced by either of the two wireline crews.

With plug & perf fracking, a wellbore (e.g. wellbore 18) is typically fracked in multiple sequential stages. At each stage a plug & perf tool is deployed downhole by a wireline crew to isolate the wellbore from the previously fracked stage. Once deployed at the desired location downhole, the wellbore casing (sometimes called a liner) which is above the plug is subsequently perforated to prepare that stage for fracking.

The portion of a 202 well that is being fracked is generally horizontal (or has some horizontal component) in its orientation, so for the purposes of this description, the term "above" refers to the portion of the wellbore up-hole (towards ground surface 19 (FIG. 1)) of the reference location and "below" refers to the portion of wellbore downhole (towards the end of the wellbore and away from ground surface 19) of the reference location.

During a typical multi-well fracking operation, a frac crew is responsible for fracking a well 202 while a wireline crew is performing wireline operations to prepare another well 202 for fracking. In subsequent stages, the frac crew and wireline crew may switch places back-and-forth to facilitate continuous operation of the multi-well system. In the case where multiple wireline crews are employed, multiple wells can simultaneously be prepared for fracking if each wireline crew has its own pump-down pump. Once the plug & perf tool has successfully perforated the wellbore casing and is removed from a particular well 202, then that particular well 202 may be considered ready for fracking and the wireline crew may move to the next well 202. Some operators may elect to perform other preparatory work (e.g. pumping acid downhole and/or the like). This circular sequence of simultaneous activities continues until all stages of all wells 202 in the multi-well system have been fracked. By design, or due to operational issues that may arise, one or more wells 202 may be removed from the fracking rotation for a period of time. Simultaneous operation by the frac and wireline crews allows for efficient utilization of the frac crew. Optimizing frac crew utilization is desirable, as it is one of the more equipment intensive and expensive components of a fracking operation.

Figure 3:
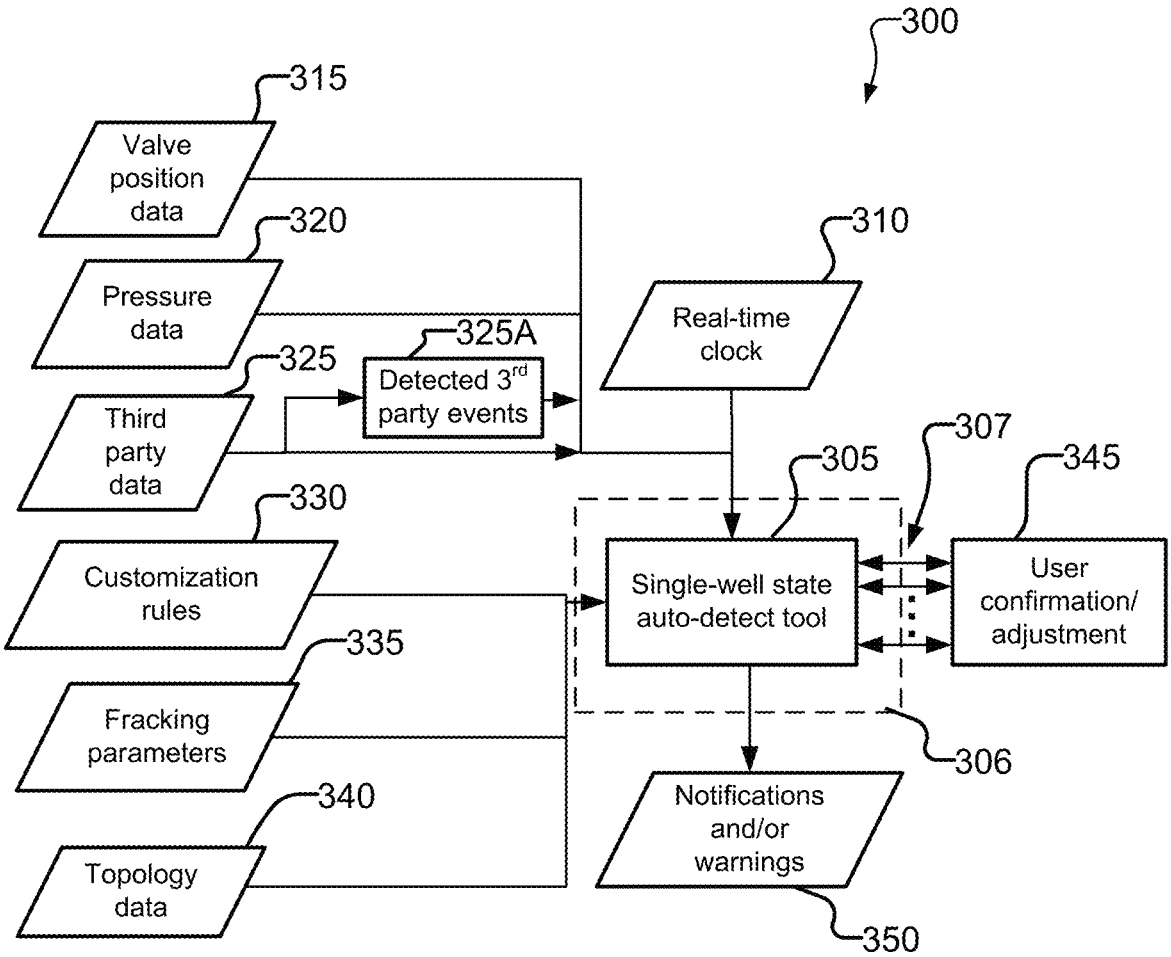
FIG. 3 shows an overview of an example data flow into a multi-well state auto-detect tool according to a particular embodiment.

FIG. 3 shows a block diagram 300 representing an example data flow in a multi-well state auto-detect tool 305 according to a particular embodiment. Multi-well state auto-detect tool 305 may be implemented by one or more suitably programmed computer(s)/processor(s)/controller(s) and/or the like 306. The computers/processors/controllers 306 used to implement auto-detect tool 305 may be referred to herein as processor 306 for brevity. Multi-well state auto-detect tool 305 provides for a time-accurate, consistent, and reliable determination and tracking of the operational state of completions operations, including plug & perf, fracking and other completions-related activities. Auto-detect tool 305 is appropriate for use in scenarios where there is a single frac crew and a single wireline crew. Auto-detect tool 305 is also useful in scenarios where there are as many as seven or more wells, the well operations utilizing one or more frac crews and multiple wireline crews. In some embodiments, auto-detect tool 305 can be configured to support the scenario where a single frac crew supports the fracking of two or more wells.

Multi-well state auto-detect tool 305 is also useful for providing detection and reporting of incorrect operating sequences. By way of non-limiting example, auto-detect tool 305 may determine that the opening or closing of a certain valve at a certain well is not expected based on the detected state of another well. Auto-detect tool 305 may further provide overall health diagnostics on well states. For example, auto-detect tool 305 may detect when a valve is beginning to leak (e.g. by detection of a change in measured pressure over time) or when downhole fracking pressure begins to leak into an adjacent well (e.g. by detection of pressure perturbation).

Multi-well state auto-detect tool 305 receives a number of inputs for performing analysis and making determinations on events and/or well state. As shown in the FIG. 3 illustration, inputs to multi-well state auto-detect tool 305 may include a real-time clock 310 or some other time keeping source for accurate timestamping of events and/or states of interest. Such events and/or states of interest (described in more detail below) may be determined and/or discriminated by auto-detect tool 305 based, without limitation, on: valve position data 315 (e.g. obtained from valve position sensors 14 (FIG. 1)), pressure data 320 (e.g. obtained from pressure sensors 16 (FIG. 1)), assorted $3^{rd}$ party data 325 (e.g. from other on-site services), customization rules 330 for providing configurable parameters specific to the customer being served, fracking parameters 335 specific to the particular fracking operation and/or the like. In some embodiments, $3^{rd}$ party data 325 may already have detected particular events 325A, although this is not necessary. Topology data 340, which includes the physical relationship (e.g. layout) between the pipes, valves 12, valve position sensors 14, pressure sensors 16 and/or the like, may additionally be used as input to multi-well state auto-detect tool 305.

In some embodiments, it can be desirable that the time stamping of data (by way of non-limiting example, any of the input data shown in FIG. 3) be performed locally at the data source (e.g. the sensor) and then communicated from the data source to processor 306. In some such embodiments, some logging and/or processing of data received by auto-detect tool 305 may be distributed (e.g. from processor 306 to similar processors local to the data source (e.g. to sensors and/or the third party sources). In some such embodiments, these data sources may be provided with or otherwise configured to access suitable data storage capability and to access clocks that are synchronized (at least to a degree sufficient for the reporting period of auto-detect tool 305) to time clock 310 used by auto-detect tool 305. In this manner, accurate time stamping and logging of events can occur locally and can be robust to failure of communication between processor 306 and the respective data source for a period of time before such communication is restored. In some embodiments, other processing aspects of auto-detect tool 305 could be distributed to suitably configured processors located at data sources. By way of non-limiting example, in some embodiments, event detection (e.g. detecting pressure crossing a threshold and/or detecting a change in valve state) may be performed locally at the data sources and reported to processor 306.

Based on the inputs described above, auto-detect tool 305 identifies and outputs a state 307 of the various wells monitored by tool 305 and/or events 307 discriminated by auto-detect tool 305 in relation to the wells that are being monitored. Output 307 of auto-detect tool 305 may be received by an end user (either a person, another software program, etc.). Output 307 of auto-detect tool 305 may be confirmed or adjusted by the end user at block 345. In some embodiments, when an unexpected event is detected by the auto-detect tool 305, a notification/warning 350 can be displayed or otherwise provided to the user.

In some embodiments, an adjustment mechanism (e.g. block 345) is provided to allow the user to adjust any one of the received multi-well state detections 307 at block 345 to remedy a perceived error in the determination of the multi-well state. In the case that other events determined by auto-detect tool 305 have accumulated since the time of the event for which the auto-detect tool's algorithm or state determination is being corrected, the auto-detect algorithm may be reapplied to those intervening events in light of the corrected multi-well state.

In some embodiments, certain inputs and/or events received at the multi-well state auto-detect tool 305 are classified as "hard" events, while other inputs and/or events are classified as "soft' events. According to an example embodiment, events identified based on inputs from valve position data 315, pressure data 320, or 3$^{rd}$ party data 325 (including, possibly 3$^{rd}$ party events 325A) may be considered "hard" events. Detected "hard" events may be considered immutable, such that they cannot be modified.

Some embodiments of the auto-detect tool 305 involve generating "soft" events as a result of processing "hard" events. For example, the auto-detect tool 305 may determine an activity state transition on the detection of certain "hard" events (e.g. detecting the frac valve opening). On the determination that the activity state has changed, a timer can be started by auto-detect tool 305. The expiry of that timer, which may be considered a "soft" event, may cause auto-detect tool 305 to signal a change to another well activity state. However, soft events, in contrast to hard events, may be mutable. If a soft event is determined to be generated as a result of an incorrect analysis of hard events or where a conflicting hard event is detected, then the effects of the soft event may be ignored or be revised by auto-detect tool 305. In such embodiments, auto-detect tool 305 may generate a new corrected activity state wherein the incorrect or inconsistent soft event is discarded.

Those skilled in the art will appreciate that the raw sensor data (e.g. valve position data 315) could first be input to a processing sub-module (not shown) to perform appropriate signal processing and event detection prior to being received by auto-detect tool 305. Such example variations do not impact the core principles of the auto-detect tool 305.

Single-Well Versus Multi-Well Detection

It will be appreciated that there are distinctions between state detection of single-well systems, multi-well systems and fracking operation of such single-well or multi-well systems. In the case of single-well detection, the operational state of each individual well is determined on the basis of data received (e.g. valve position and pressure sensors) for that individual well. When single-well state detection is applied to a multi-well operation, multiple copies of a single-well monitoring and analysis tool would be required on the multi-well site, one for each well. In this scenario, the state-detection tool used for each well would not be able to detect or respond to conflicting operations based on data received at the monitoring tools of the other wells.

In contrast, in the case of multi-well detection, the operational state of each well may be determined based on any or all available data, which may include data corresponding to one or more other wells in the multi-well system, in addition to the well-specific data inputs noted above. Multi-well state detection involves a more intricate algorithmic design, but can provide much more robust and accurate detection performance.

As discussed in detail below, the use of a multi-well state auto-detect tool advantageously permits precise activity state information to be obtained by inferring a well's current status based in part on observable activity (e.g. sensor based information and/or events) from other wells.

According to particular non-limiting example embodiments, the following, non-limiting, list of operational states may be identified and utilized by the multi-well state auto-detect tools described herein. Each of the example operational states is accompanied by a description of what that state entails.

- Well Closed—there is no current activity on the well in this state. In some embodiments, the Well Closed state is subdivided into two sub-states; one in which the well is closed and is awaiting fracking, and another in which the well is closed and is awaiting plug & perf.
- Frac Swapover—frac crew is switching to the well in preparation for fracking.
- Frac Pressure Test—testing of the pressure integrity of the frac feed pipes and wellhead before starting to frac.
- Fracking—pumping of frac fluid and proppant downhole.
- Wireline Swapover—Wireline crew is switching to the well and preparing to deploy the plug & perf tool.
- Wireline Pressure Test—testing of the pressure integrity of the wireline tool feed port and pump down feed pipes before running the plug & perf tool downhole.
- Wireline Plug & Perf—the wireline crew is preparing the next downhole section for fracking by running the plug & perf tool downhole and detonating to perforate the wellbore casing/liner.
- Valve Greasing—preventive maintenance on the valves.
- Frac Idle—the valves involved in fracking are open but the frac pump(s) are not active.
- Wireline Run In—the first part of Wireline Plug & Perf, where a tool is being run into the wellbore and activated.
- Wireline Pull Out—removal of a wireline tool after Run In and activation.
- Other—a "catch-all" state that may not fit in one of the above auto-detected states. Operating personnel can override the auto-detect algorithm when an unexpected situation (or state not currently detected by the algorithm) arises and identify the state as "Other". The Other state may include a number of sub-states which are customer and/or site dependent.

It will be appreciated that this example list is non-exhaustive, and may grow or be varied based on factors such as customer specifications, differences in well-sites, available measurements and the hardware capabilities of the auto-detect system.

Often, there are prescribed times for the completion of certain well activities, or how long a well should remain in a given state. Some embodiments of the present invention comprise detecting and identifying when the performance of a well activity exceeds a prescribed amount of time. As an illustrative example, a frac crew may be allotted 15 minutes to perform a swapover from a well which had just been fracked to the subsequent well to be fracked. If the swapover takes longer than the allotted time, this may be noted and recorded by a multi-well state auto-detect tool.

As an example, an algorithm of the multi-well auto-detect tool may initiate the timer at the start of the swapover activity based on detecting that one or more valves (e.g. the master valves) have closed. The detection of the one or more valves closing may be considered a "hard" event, as discussed above. Upon the expiry of the timer, a "soft" event may be generated, indicating the transition to the activity state that is expected upon completion of the swapover and on expiry of the timer. However, if the timer expires while the swapover activity is still ongoing, then the soft event based on the expiration of the timer can be overridden, as discussed above. The new activity state may be one that describes the swapover activity exceeding the allotted time. Conversely, some activities may be expected to last at least a minimum specified time. Upon the detection of some hard event (e.g. detecting a certain valve opening) which indicates that the minimum time was not met, the hard event may be used by an auto-detect algorithm to override the soft event dictated by the timer, or otherwise incorporate the missed minimum time to determine a new activity state.

Data Sources

It is preferable that sensor data and events are time-stamped based on a real-time clock. This is a desirable feature for well status identification, so the time at which a particular piece of sensor data giving rise to a determined change in state may be known and recorded. Furthermore, there may be a number of supplementary services which use the output of the auto-detect tool which rely on accurately timestamped data. Non-limiting examples of such supplementary services include services for operational efficiency tracking, billing, and/or the like.

A typical oil-field completions wellhead has multiple valves connecting various pipes to the wellbore. For example, one or more "master" valves located closest to the underground portion of the wellbore 18 are used in series to "shut in" the well and allow the remainder of the well head and connecting pipes to be depressurized (e.g. upper master valve 12A and lower master valve 12B). Other valves are used to connect the multitude of frac pumps (e.g. valves 12E and 12F) to the rest of the wellhead. Yet other valves provide an opening to insert a "plug & perf" tool into the wellbore 18 (e.g. swab valve 12G), etc.

It is desirable to know the open/closed status of each valve connected to the wellhead and/or to associated services. There are a variety of techniques known in the art for monitoring the status of a valve. The use of valve position sensors discussed above is one such technique. Once connected to the valves and calibrated to identify the valves' maximum and minimum positions, valve position sensors are able to provide detailed information on the status of corresponding valves. The valves of the wellhead are often located in a potentially explosive environment. Therefore, whatever sensor technology is employed for monitoring valves, along with their connections to data collection equipment, should meet desired safety specifications. These specifications are well-known to those skilled in the art. In fracking operations, it is desirable to physically connect each valve position sensor located at the wellhead to a data acquisition system located outside the hazardous zone. Typically, the electrical signal from each sensor passes through an electrical safety barrier.

Some valve position sensors comprise connecting a linear position potentiometer to the valve stem to measure its movement. In such cases, the voltage of the signal from the potentiometer indicates the open/closed position of the valve. Other exemplary available sensor technologies can utilize an industry standard 4-20 mA interface, or may connect wirelessly to remote data acquisition devices to report the reading digitally. These are merely examples of suitable VPS implementations and other sensor configurations and/or communications technologies could be used. With reference to FIGS. 1 and 3, valve position sensors 14 may be located at the wellhead, and connected to auto-detect tool 305 which may in turn be located outside the hazardous zone.

Physical conditions on a completions wellsite can be extreme at times and it is not uncommon for a sensor (e.g. VPS 14) to fail, or for communication with the data acquisition system to be disrupted. A complete failure of a valve position sensor can often be detected electrically. In the case of a linear potentiometer, the electrical interface circuit can detect the absence of the expected impedance of the sensor. By way of non-limiting example, in the case of a 4-20 mA device, detecting current levels outside this expected range would indicate an open-circuit or short-circuit failure of the sensor.

Potentially more problematic is the soft failure of a sensor (e.g. VPS 14) in which the sensor is still operating, but is providing incorrect data. In the case of a voltage based linear position potentiometer, this can occur, for example, if the electrical connection to the sensor becomes contaminated with fluid, or the sensor itself suffers ingress of fluid. Robust designs of the sensor housings and cabling can minimize the likelihood of a failure, but cannot eliminate this risk entirely.

Accordingly, it is desirable for multi-well state auto-detect tool 305 to be designed (e.g. with suitable software algorithms) to tolerate and/or compensate for known hard-failures and unknown soft-failures as best as possible. In some embodiments, this ability to tolerate and/or compensate for known hard-failures and unknown soft-failures may be accommodated by combinations of one or more of: expected sequences of well operations (e.g. from customization rules) and state predictions and/or state change predictions with corresponding confidence levels. Together, these bases can be used to detect potentially incorrect operations (states) and/or to identify the most likely operation (state).

According to an illustrative example embodiment, there may be three primary events and three secondary events of interest when monitoring valve position status (e.g. VPS sensors 14 and their corresponding valves 12). In this illustrative example, primary events include:

- valve 12 open;
- valve 12 closed;
- valve 12 being greased; and secondary events in this example include:

- valve 12 being in transition from being open or closed or being greased to a different one of these states;
- valve sensor 14 going offline (e.g. due to hard-failure or cable disconnecting); and
- valve sensor 14 going online (e.g. due to cable reconnecting).

In the typical case, auto-detect tool 305 may be configured (e.g. using suitable software) to react to primary events and ignore the secondary events. However, secondary events such as a sensor 14 going online may be of interest if the sensor 14 monitoring a valve 12 is reporting a primary status (e.g. opening/closing/greasing) which is inconsistent with that valve's last known status. A recorded event indicating that a particular valve 12 is closing when that valve's previous state indicates that the valve 12 was already closed is one such example of an inconsistency. In such a scenario, it may be helpful to examine secondary events to determine the cause of this inconsistency. As an example, auto-detect tool 305 may be configured (e.g. with suitable software) to assess whether that valve 12 had recently gone offline and then returned online. The complexity of reacting to such an inconsistent event in the case that the corresponding sensor 14 was offline for a period of time is that it will not be known whether there have been other changes in the state of the valve 12 while the sensor 12 was offline and the particular times at which those valve state changes occurred.

Assuming a properly functioning and calibrated valve position sensor 14, it is relatively simple to detect when the valve 12 corresponding to that sensor 14 is opened or closed. For example, when the sensor reading is within a defined margin of the calibrated open or closed positions, the valve 12 may be considered by auto-detect tool 305 to be open or closed as is appropriate. Those skilled in the art will appreciate that application of noise filtering, and/or threshold hysteresis (in physical hardware and/or in software), among other techniques, may be helpful in conditioning the sensor reading.

Valves 12 usually require regular greasing to minimize the physical erosion that the valves 12 may undergo from operating in an environment where fluids are pumped at high pressures, especially where the fluid may contain abrasive proppant. It may be advantageous in some scenarios for the auto-detect tool 305 to be configured (e.g. with suitable software) to know when a valve 12 is being greased.

When a valve 12 is manually greased, it is common to partially open the valve 12, pump grease into the valve casing, and then continuously open and close the valve 12 a number of times. Therefore, one technique employed to detect greasing by the auto-detect tool 305 may involve monitoring the dynamic position of a valve 12 based on information from its corresponding VPS 14. When a valve 12 is observed to be partially opened or closed and remains at that position for a period of time, then that valve 12 may be identified as potentially being greased. Note that a contaminated sensor 14 can sometimes display this same behaviour even though the corresponding valve 12 remains fully open or closed. Therefore, auto-detect tool 305 should be aware of this possible incorrect reporting of valve position status. This possible erroneous detection of a valve being greased can be addressed in a number of ways. By way of non-limiting example, valve greasing is typically performed at certain times during the frac/wireline cycle, so detected greasing events that do not occur at expected times may be ignored. Such expected greasing times may be part of $3^{rd}$ party data 325, for example. As another example, $3^{rd}$ party data 325 may include greasing data. If so, then detected greasing events can be ignored unless accompanied by $3^{rd}$ party greasing data. As yet another example, user feedback 345 may be used to override an erroneously detected greasing event.

Detecting when greasing has completed is more challenging than detecting when greasing begins, as there is no explicit action that identifies the completion of greasing. After a valve 12 is greased, it is open or closed as needed for a particular applications. The greasing process may be completed at this point, or the crew may proceed to grease another valve 12. Some operators do not permit greasing of any valves 12 while any other part of the well system is pressurized. In these cases, detection of high pressure levels (e.g. by pressure sensors 16) can signify that greasing was completed at the time of the most recent valve opening or closing event. Another potential option for determining when greasing is complete is to monitor the time that elapses after a valve opening or closing event. If this time exceeds a configurable threshold limit, greasing is assumed to have occurred and may be considered to be completed at the subsequent valve opening or closing event.

Valves 12 take a finite amount of time to move from a closed position to an open position, and vice versa. Thus, auto-detect tool 305 may be configured (e.g. using suitable software) to consider that a valve 12 moving between the open and closed state (and vice versa) to have a state of being in transition. As discussed, the state of being in transition is typically defined as being a secondary event. However, there may be scenarios where secondary events are useful as a means to identify a faulty sensor 14. For example, a valve 12 which appears to be in transition for an extended period of time may indicate that the corresponding sensor 14 is failing.

For general completions site operational purposes, it is common to have multiple pressure sensors 16 connected to detect the pressure in the wellheads 205 and their supporting feeder pipes. Auto-detect tool 305 may monitor such pressure sensors 16. One obvious reason to monitor these pressures is safety. The extreme pressure levels used during fracking can be deadly in the event of a mechanical failure or accident. Constant monitoring of the pressure levels in different segments of the surface system is desirable to avoid putting people and equipment in potentially dangerous situations.

The above discussion of primary/secondary events is focused on events surrounding the monitoring of the status of valves 12 and valve positions using valve position sensors 14. However, auto-detect tool 305 may additionally or alternatively be configured (e.g. using suitable software) to ascertain and/or utilize primary and secondary events based on the monitoring of data received from pressure sensors 16. Similar to the benefits from having knowledge of valve positions, it can also be useful to have knowledge of pressure data to automatically detect the operational status of each well in a multi-well operation.

As an example, detection of high pressure levels in a wellhead 205 but not in the associated wellbore could suggest that a pressure test is in progress. Pressure tests are often performed against closed master valves 12 to confirm the integrity of the surface systems before opening the master valves 12 to begin a high pressure operation (such as fracking). In scenarios without pressure sensors, one might infer that a pressure test is either pending or is ongoing if the master valves 12 are closed and one of the other sets of valve 12*s*, such as the pump-down valve 12C or frac valves 12E, 12F, are open. However, the confidence level of this determination would be significantly lower than if pressure data from pressure sensors 16 was additionally available.

Similar to the valve position sensor 14, pressure sensors 16 often utilize a standard 4-20 mA interface. When the pressure measured at the 4-20 mA device is nominally zero, the device sources a 4 mA DC electrical current. As the measured pressure increases, the device sources an increasing DC electrical current until its maximum specified pressure level is reached at which point the device sources a 20 mA DC electrical current. Electrical safety barriers are commonly used due to the often potentially explosive environment in the immediate vicinity of the wellhead 205. These are design practices which are well known to those skilled in the art. With reference to FIG. 3, the described pressure sensors 16 may be connected to provide pressure sensor data 320 to auto-detect tool 305.

A complete failure of a pressure sensor 16 can often be detected electrically. In the case of a 4-20 mA device, detecting current levels outside this expected range would indicate an open-circuit or short-circuit failure of the sensor 16. As discussed, a potentially more problematic situation is the soft failure of a sensor 16 in which the sensor is still operating but is providing incorrect data. According to an illustrative example embodiment, there may be two primary events of interest when monitoring pressure:

Pressure rising above a configurable threshold; and

Pressure falling below a configurable threshold.

Noise filtering and hysteresis (in physical hardware and/or in software) can be advantageously used when making such threshold determinations to provide more stable results.

According to this simple example, a detected "high" pressure can be interpreted to indicate active pumping and a detected "low" pressure can be interpreted to indicate that pumping is inactive.

The above simple low/high threshold event detection may often be too simplistic for properly monitoring the nuances present in fracking operations. In some embodiments, the following two primary events may be added to the event detection strategy/algorithm of auto-detect tool 305 to provide a more detailed representation of fracking operations:

Pressure rising or falling to different levels of a configurable multi-level pressure threshold scheme; and Dwell-time.

Using multi-level pressure thresholds, it is possible to differentiate between a greater number of possible well states. Auto-detect tool 305 may be configured to discriminate between the augmented set of primary events above to additionally interpret readings from pressure sensors 16 to indicate a depressurized system, a system exposed to the natural pressure level of the downhole formation, and a system under active pumping, for example.

When active pumping starts, or more commonly when it stops, the resulting sudden change in pressure will propagate downhole and reflect back to the surface. This phenomenon may be referred to as "water hammer" and pressure changes can repeatedly reflect back and forth between the surface and downhole. As an example, it is common for a well to have a measured depth of about 3 to 5 miles, or more. At these depths, the round-trip travel time of the water hammer can be in the range of about 6 to 10 seconds, or more. As a result of this water hammer effect, detection of changes in pressure state based only on threshold crossing events may result in auto-detect tool 305 erroneously detecting multiple pressure change events and may lead to spurious results when attempting to ascertain a next state (e.g. output state prediction 545 of method 500 described in more detail below). Advantageously, the addition of a configurable dwell time criterion to pressure threshold criteria for indicating pressure change events can alleviate this issue. The dwell time criterion may represent a minimum amount of time Δ that must have elapsed between detected pressure threshold crossings, before the pressure threshold crossing is recognized as a pressure change event. For example, if it is estimated that water hammer echo may take 10 seconds to travel back and forth in a wellbore, then the dwell time criterion Δ may be set at a minimum of Δ15 seconds, before any pressure threshold crossing is recognized as a potential pressure change event. This dwell time criterion prevents auto-detect tool 305 from concluding that there is a pressure change event on each occurrence of a water hammer echo.

Figure 4:
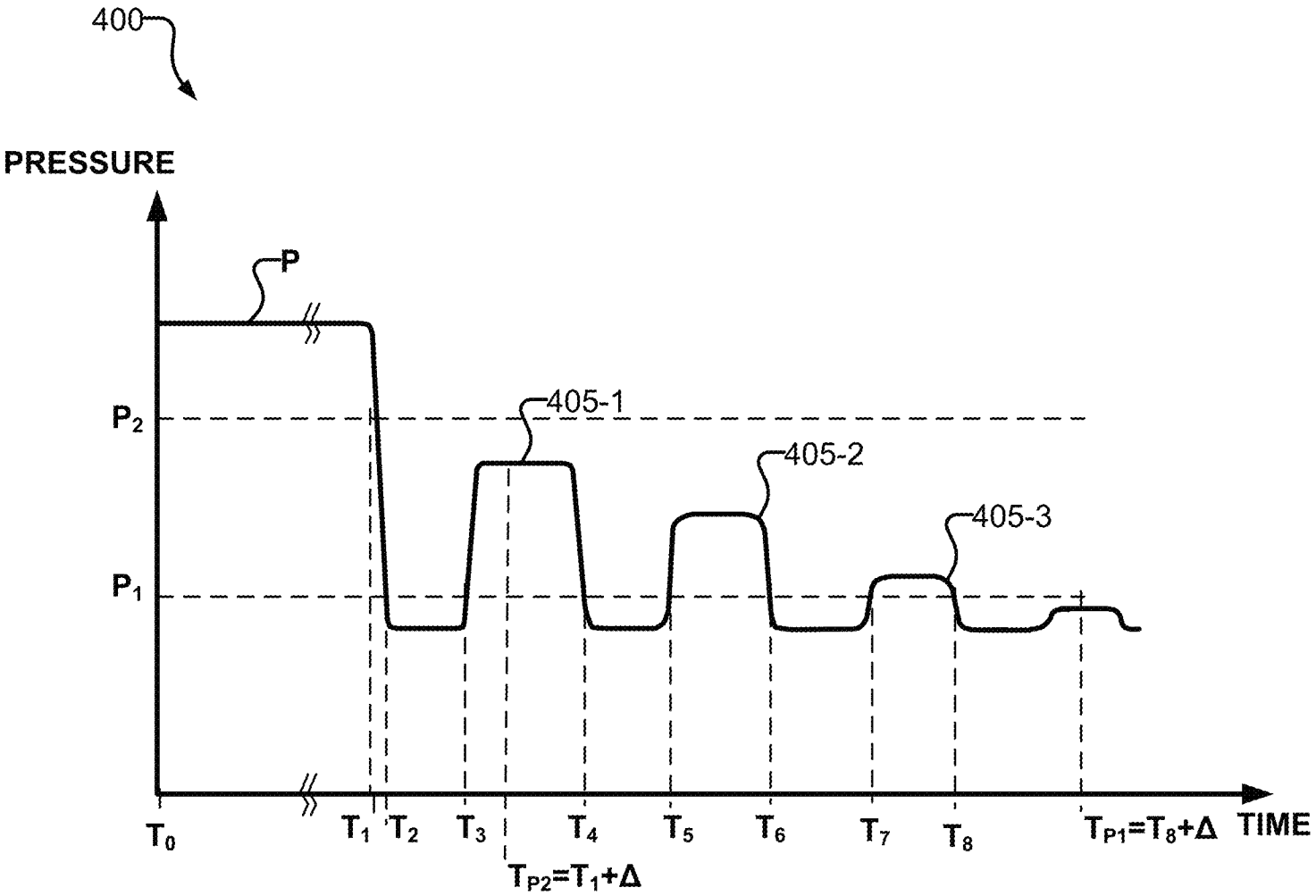
FIG. 4 is a chart of pressure versus time showing exemplary water hammer echoes.

FIG. 4 depicts a plot 400 of pressure measured at the surface versus time showing the effects of water hammer echoes. As shown, there are two defined pressure thresholds $P_1$, and $P_2$ recognized by auto-detect tool 305 according to an example embodiment. A measured pressure P greater than $P_2$ may be considered "High", a pressure P between $P_2$ and $P_1$ may be considered "Medium" and a pressure less than $P_1$ may be considered "Low". In some embodiments, auto-detect tool is configured (e.g. by suitable programming) to discriminate between these three pressure states based on pressure sensor data 320 (FIG. 3) from one or more pressure sensors 16 (FIG. 1).

Initially in the FIG. 4 example (e.g. prior to $T_1$), frac pumps 23 (FIG. 1) are active and the pressure P, which is above the threshold $P_2$, is considered "high". Just before time $T_1$, frac pumps 23 are shut down and the measured pressure P drops below $P_2$ (crosses the $P_2$ threshold from above to below) at time $T_1$. Then, a very short period of time thereafter, at $T_2$, the pressure drops below the $P_1$ threshold (crosses the $P_1$ threshold from above to below). However, the pressure does not remain below $P_1$ due to water-hammer echoes reflecting back and forth between the surface and the bottom of the well causing elevated pressure measurements at the surface. This is illustrated in FIG. 4 by water hammer echoes (pressure spikes) 405-1, 405-2 and 405-3, each subsequent water hammer echo being diminished in intensity. FIG. 4 shows, that due to the water hammer effect, the measured pressure P crosses the $P_1$ threshold a number of times after $T_2$. For example, after the first drop in pressure below the $P_1$ threshold at $T_2$, the pressure crosses the $P_1$ threshold again at $T_3$, $T_4$, $T_5$, $T_6$, $T_7$ and $T_8$. The water hammer echo period may be defined to be the time between the start of a pressure rise to the start of the next subsequent pressure drop or between the start of a pressure drop to the start of the next subsequent pressure rise. For example, the FIG. 4 example shows a water hammer period approximately between $T_1$ and $T_3$ and another water hammer period approximately between $T_3$ and $T_4$, These threshold crossings could erroneously be considered to be pressure-related events. However, auto-detect tool 305 may incorporate a dwell time criteria Δ when considering a pressure threshold crossing event. Auto-detect tool 305 may be configured (e.g. by suitable programming) to detect pressure change event using the logic presented in the following pseudocode:

```
{
  // Local variables whose values are preserved between calls
  // - DynamicState: pressure state previously determined, assuming DwellTime = 0
  // - State: pressure state previously reported
  // - DwellTimer : maintained for each possible DynamicState
  // Configurable parameters
  // - PressureThresholds: define boundaries between pressure states
  // - DwellTime: time duration for State change
  // - Hysteresis: used when determining change in DynamicState
  determine the new DynamicState (by comparing current sample to defined thresholds, subject
    to Hysteresis);
  IF new DynamicState is not the same as previous reported State
  THEN
    IF new DynamicState is not the same as previous DynamicState
    THEN
      IF new DynamicState is farther away from the last reported State than is the
        previous DynamicState
      THEN
        reset DwellTimer for all Dynamic states passed through or entered to
          get from the previous DynamicState to the new DynamicState;
      ENDIF
```

-continued

```
    ENDIF
    LOOP starting at the new dynamic state and working towards the previous
      reported State
      IF time since DwellTimer was reset for this dynamic state is greater than
        dwellTime
      THEN
        set State to this dynamic state;
        exit from loop;
      ENDIF
    ENDLOOP
  ENDIF
  report the State;
}
```

This pseudocode is now discussed using the FIG. 4 pressure profile as an example of the application of this pressure state change logic incorporating dwell time. In the case of the FIG. 4 example, there are three pressure states $P>P_2$=high; $P_2>=P>=P_1$=medium; and $P<P_1$=low. That is, the PressureThresholds used in the pseudocode are set at $P_1$ and $P_2$. Prior to $T_1$, it is assumed that both the State and Dynamic State variables are high, the DwellTimer=0. Further, the DwellTime parameter is set to DwellTime=Δ, where Δ is set to be greater than the expected water hammer echo period (e.g. 1.25, 1.5 or 1.75 times the expected water hammer period). Hysteresis is an optional parameter used to mitigate false positive threshold crossings based on noise or the like. By way of non-limiting example, hysteresis may involve requiring that a threshold crossing traverse past the threshold by a configurable amount, HYST, where HYST>=0. So, for example, when the pressure P crosses from below a threshold (e.g. P2) to above the threshold (e.g. $P_2$), the pressure may be deemed to have crossed threshold only after $P>P_2$+HYST. Similarly, when the pressure P crosses from above a threshold (e.g. $P_2$) to below the threshold (e.g. $P_2$), the pressure may be deemed to have crossed threshold only after $P<P_2$-HYST.

When the pressure state detection method is called for the first time in the time period $T_1<t<T_2$, the new DynamicState=medium (i.e. $P_2>=P>=P_1$), consequently the first IF inquiry is positive (since the new DynamicState=medium≠State=high), the second IF inquiry is positive (since new DynamicState=medium≠previous DynamicState=high) and the third IF inquiry is positive (since new DynamicState=medium is farther from State=high than previous DynamicState=high is from State=high). So, a DwellTimer is reset for new DynamicState=medium. Then, the pseudocode enters the LOOP, but the IF inquiry inside the LOOP is negative (since the DwellTimer for DynamicState=medium (set in the time period $T_1<t<T_2$) is less than DwellTime=Δ), so the reported State stays at State=high.

If the pressure state detection method is called a second or subsequent time in the time period $T_1<t<T_2$, the new DynamicState=medium (i.e. $P_2>=P>=P_1$) and the previous DynamicState=medium, consequently the first IF inquiry is positive (since the new DynamicState=medium≠State=high), but the second IF inquiry is negative (since new DynamicState=medium=previous DynamicState=medium). Then, the pseudocode enters the LOOP, but the IF inquiry inside the LOOP is negative (since the DwellTimer for DynamicState=medium (set in the time period $T_1<t<T_2$) is less than DwellTime=Δ), so reported State once again stays at State=high.

When the pressure state detection method is called for the first time in the time period $T_2<t<T_3$, the new DynamicState=low (i.e. $P<P_1$), consequently the first IF inquiry is positive (since the new DynamicState=low≠State=high), the second IF inquiry is positive (since new DynamicState=low≠previous DynamicState=medium) and the third IF inquiry is positive (since new DynamicState=low is farther from State=high than previous DynamicState=medium is from State=high). So, a DwellTimer is reset for new DynamicState=low. Then, the pseudocode enters the LOOP, but the IF inquiry inside the LOOP is negative (since both the DwellTimer for DynamicState=low (set in the time period $T_2<t<T_3$) and for DynamicState=medium (set in the time period $T_1<t<T_2$) are less than DwellTime=Δ), so the reported State stays at State=high.

If the pressure state detection method is called a second or subsequent time in the time period $T_2<t<T_3$, the new DynamicState=low (i.e. $P<=P_1$) and the previous DynamicState=low, consequently the first IF inquiry is positive (since the new DynamicState=low≠State=high), but the second IF inquiry is negative (since new DynamicState=low=previous DynamicState=low). The pseudocode enters the LOOP, but the IF inquiry inside the LOOP is negative (since both the DwellTimer for DynamicState=low (set in the time period $T_2<t<T_3$) and for DynamicState=medium (set in the time period $T_1<t<T_2$) are less than DwellTime=Δ), so the reported State stays at State=high.

When the pressure state detection method is called for the first time in the time period $T_3<t<TP_2=T_1+\Delta$, the new DynamicState=medium (i.e. $P_2>=P>=P_1$), consequently the first IF inquiry is positive (since the new DynamicState=medium≠State=high), the second IF inquiry is positive (since new DynamicState=medium≠previous DynamicState=low) but the third IF inquiry is positive (since new DynamicState=medium is closer to State=high than previous DynamicState=low is to State=high). So, the DwellTimer for new Dynamic State=medium is not reset. However, the pseudocode does enter the LOOP, but the IF inquiry inside the LOOP is negative (since both the DwellTimer for DynamicState=low (set in the time period $T_2<t<T_3$) and for DynamicState=medium (set in the time period $T_1<t<T_2$) are less than DwellTime=Δ), so the reported State stays at State=high.

When the pressure state detection method is called for the first time in the time period $T_{P2}=T_1+\Delta<t<T_4$, the DwellTimer for DynamicState=medium (set in the time period $T_1<t<T_2$) has expired, In this time period, new DynamicState=medium (i.e. $P_2>=P>=P_1$), consequently the first IF inquiry is positive (since the new DynamicState=medium≠State=high), but the second IF inquiry is negative (since new DynamicState=medium=previous DynamicState=medium). The pseudocode does enter the LOOP, and the IF inquiry inside the LOOP is positive for the DwellTimer for DynamicState=medium (set in the time period $T_1<t<T_2$), so the reported state is updated to State=medium.

When the pressure state detection method is called for the first time in the time period $T_4<t<T_5$, the new DynamicState=low (i.e. $P<P_1$), consequently the first IF inquiry is positive (since the new DynamicState=low≠State=medium), the second IF inquiry is positive (since new DynamicState=low≠previous DynamicState=medium) and the third IF inquiry is positive (since new DynamicState=low is farther from State=medium than previous DynamicState=medium is from State=medium). So, a DwellTimer is reset for new DynamicState=low. Then, the pseudocode enters the LOOP, but the IF inquiry inside the LOOP is negative (since the DwellTimer just reset in the time period $T_4<t<T_5$ for DynamicState=low is less than DwellTime=Δ), so the reported State stays at State=medium.

If the pressure state detection method is called a second or subsequent time in the time period $T_4<t<T_5$, the new DynamicState=low (i.e. $P<P_1$) and the previous DynamicState=low, consequently the first IF inquiry is positive (since the new DynamicState=low≠State=medium), but the second IF inquiry is negative (since new DynamicState=low=previous DynamicState=low). Then, the pseudocode enters the LOOP, but the IF inquiry inside the LOOP is negative (since the DwellTimer for DynamicState=low (set in the time period $T_4<t<T_5$) is less than DwellTime=Δ), so reported State once again stays at State=medium.

When the pressure state detection method is called at any time in the time period $T_5<t<T_6$, the new DynamicState=medium (i.e. $P_2>=P>=P_1$), consequently the first IF inquiry is negative (since the new DynamicState=medium=State=medium). The LOOP is not entered in this iteration and the reported state stays at State=medium.

When the pressure state detection method is called for the first time in the time period $T_6<t<T_7$, the new DynamicState=low (i.e. $P<P_1$), consequently the first IF inquiry is positive (since the new DynamicState=low≠State=medium), the second IF inquiry is positive (since new DynamicState=low≠previous DynamicState=medium) and the third IF inquiry is positive (since new DynamicState=low is farther from State=medium than previous DynamicState=medium is from State=medium). So, a DwellTimer is again reset for new DynamicState=low. Then, the pseudocode enters the LOOP, but the IF inquiry inside the LOOP is negative (since the DwellTimer just reset in the time period $T_6<t<T_7$ for DynamicState=low is less than DwellTime=Δ), so the reported State stays at State=medium.

If the pressure state detection method is called a second or subsequent time in the time period $T_6<t<T_7$, the new DynamicState=low (i.e. $P<P_1$) and the previous DynamicState=low, consequently the first IF inquiry is positive (since the new DynamicState=low≠State=medium), but the second IF inquiry is negative (since new DynamicState=low=previous DynamicState=low). Then, the pseudocode enters the LOOP, but the IF inquiry inside the LOOP is negative (since the DwellTimer for DynamicState=low (reset in the time period $T_6<t<T_7$) is less than DwellTime=Δ), so reported State once again stays at State=medium.

When the pressure state detection method is called at any time in the time period $T_7<t<T_8$, the new DynamicState=medium (i.e. $P_2>=P>=P_1$), consequently the first IF inquiry is negative (since the new DynamicState=medium=State=medium). The LOOP is not entered in this iteration and the reported state stays at State=medium.

When the pressure state detection method is called for the first time in the time period $T_8<t<T_{P1}=T_8+\Delta$, the new DynamicState=low (i.e. $P<P_1$), consequently the first IF inquiry is positive (since the new DynamicState=low≠State=medium), the second IF inquiry is positive (since new DynamicState=low≠previous DynamicState=medium) and the third IF inquiry is positive (since new DynamicState=low is farther from State=medium than previous DynamicState=medium is from State=medium). So, a DwellTimer is again reset for new DynamicState=low. Then, the pseudocode enters the LOOP, but the IF inquiry inside the LOOP is negative (since the DwellTimer just reset in the time period $T_8<t<T_{P1}=T_8+\Delta$ for DynamicState=low is less than DwellTime=Δ), so the reported State stays at State=medium.

When the pressure state detection method is called for the first time in the time period $t>T_{P1}=T_8+\Delta$, the DwellTimer for DynamicState=low (reset in the time period $T_8<t<T_{P1}=T_8+\Delta$) has expired, In this time period, new DynamicState=low (i.e. $P<P_1$), consequently the first IF inquiry is positive (since the new DynamicState=low≠State=medium), but the second IF inquiry is negative (since new DynamicState=low=previous DynamicState=low). The pseudocode does enter the LOOP, and the IF inquiry inside the LOOP is positive for the DwellTimer for DynamicState=low (set in the time period (reset in the time period $T_8<t<T_{P1}=T_8+\Delta$), so the reported state is updated to State=low.

When the pressure state detection method is called for a second or subsequent time in the time period $t>T_{P1}=T_8+\Delta$, the new DynamicState=low and consequently, the first IF inquiry is negative (since the new DynamicState=low≠State=low). The state stays at State=low.

In some embodiments, such as where it is dictated by customer desires for operations tracking, it may be desirable to consider the time of a pressure change event to be the time of the originally detected threshold crossing. For example, the time that the state changed to State=medium ($P_2>=P>=P_1$) could be considered to be. at time $T_1$ in FIG. 4 even though the pressure change event is not conclusively determined until after the dwell time criterion has been satisfied (e.g. after time $T_{P2}=T_1+\Delta$ in FIG. 4). Similarly, the time that the state changed to State=low ($P<P_1$) in FIG. 4 could be considered to be at time T2 in FIG. 4 even though the pressure change event is not conclusively determined until after the ddwell time criterion has been satisfied (e.g. after time $T_{P1}=T_8+\Delta$ in FIG. 4). That is, even when the pressure change event is not determined until after the dwell time criterion has elapsed, the timing of the pressure change may be assigned to reflect the initial threshold crossing. It may be desirable, therefore, to record a time stamp for the first detected pressure threshold crossing that occurs after each new concluded pressure change event.

The potential presence of transient water-hammer effects may also be taken into consideration when a sensor goes from being offline to being online. An instantaneous pressure level reading is available as soon as the sensor comes online, but this may not be an accurate representation of the pressure state. For example, considering FIG. 4, if the pressure sensor came online between $T_7$ and $T_8$, then the sensor might erroneously conclude that the pressure state is medium ($P_2$>=P>=$P_1$), but if a dwell time criterion similar to that discussed above in method 400, then the ultimately concluded after the pressure sensor goes online would be accurate. Such a dwell time criterion may involve waiting, after a pressure sensor goes from offline to online, for a dwell time Δ wherein no pressure threshold crossings are detected before concluding the pressure state of the sensor. Such a dwell time criterion can advantageously be incorporated before conclusively determining the pressure state after a pressure sensor goes from offline to online.

A variety of 3rd party data (e.g. 3rd party data 325 in FIG. 3) is often available on-site and can be made available to auto-detect tool 305 in real time. Non-limiting examples of 3rd party data which may be available include:

- a flow rate from the frac pumping provider (e.g. for each individual pump, from some subset of the pumps, from the total of all pumps and/or some combinations of these);
- a flow rate from the pump down pumping provider; and
- a proppant concentration.

In some embodiments processing of raw 3rd party data may be performed by auto-detect tool 305 (configured e.g. with suitable software) to identify events of significance. Non-limiting examples of significant events include the time when the proppant concentration rises above a configurable threshold or drops below a configurable threshold and the time when the accumulated proppant amount reaches a configurable threshold and/or the like. The use of 3rd party data advantageously provides insight into certain operational metrics and states into which natively controlled sensors 14, 16 of auto-detect tool 305 may not (on their own) be able to provide insight. As an illustrative example, knowledge of the accumulated proppant since the start of the fracking stage would enable auto-detect tool 305 to better determine if fracking is complete for a given stage when frac pumps 23 are shut down. If fracking is determined to not have been completed based on the accumulated proppant, then the shutdown of frac pumps 23 could indicate an unexpected situation that requires attention before resuming fracking on that stage.

Combining knowledge of fracking flow rate and/or pump down flow rate (from 3rd party data) with observed pressure levels (e.g. from pressure sensors 16) can advantageously reveal subtle details of a fracking operation. As an illustrative example, a high wellhead pressure (e.g. measured at pressure sensor 16A) combined with a minimal frac pump flow rate may indicate that a pressure test is ongoing. A moderate wellhead pressure combined with a high frac pump flow rate may indicate pumping into well fractured rock. Lastly, a high wellhead pressure and low frac pump flow rate may indicate pumping into a well with fresh rock formation (i.e. a well that is not yet well fractured) or a well that has been saturated with proppant.

Fracking Parameters

There are a number of configurable parameters and/or procedures which may be used to enhance performance of auto-detect tool 305. These parameters and/or procedures may not have been captured by valve position sensors 14 (valve position data 315), pressure sensors 16 (pressure sensor data 320) and/or 3rd party data 325 discussed above. Following are descriptions of a set of example non-exhaustive parameters and/or procedures which may be used by auto-detect tool 305. Such example parameters and/or procedures may be embodied in fracking parameters 335 of FIG. 3.

Valve Groupings and Orientations

A multi-well completions site will have multiple valves for each well (such as valves 12 in FIG. 1). Auto-detect tool 305 may be configured (e.g. suitably programmed) to know which of the expected valve groupings are being monitored and by which sensors (e.g. valve positioning sensors 14 in FIG. 1). Referring to the FIG. 1 example, auto-detect tool 305 should be configured to know that VPS 14A and 14B correspond respectively to master valves 12A and 12B, VPS 14E, 14F correspond respectively to frac valves 12E, 12F etc.

Furthermore, auto-detect tool 305 may be configured to know whether the valves 12 of a multi-valve group are arranged in series or in parallel. In a series arrangement, a multi-valve group is effectively closed if at least one of the valves 12 is closed. In contrast, in a parallel arrangement, a multi-valve group is effectively closed only if all of the valves 12 are closed. Knowledge of such conditions may accordingly inform the determinations made by auto-detect tool 305.

Auto-detect tool 305 may also be configured (e.g. by suitable programming) to be capable of making some determinations based on incomplete information. For example, in a series valve arrangement, one of the valve sensors 14 corresponding to a valve 12 in a valve group may be offline. In this scenario, if it is known that none of the other valves 12 are closed and that at least one valve 12 is open, then the valve group may be determined by auto-detect tool 305 to be potentially open. As another illustrative example, if one of the sensors 14 corresponding to a valve 12 in a parallel valve group is offline and it is known that none of the other valves 12 are open and that at least one valve 12 is closed, then the group may be determined to be potentially closed.

Nominal Wellbore Pressure

Auto-detect tool 305 may be configured to know the nominal wellbore pressure for a particular wellbore. Knowledge of the expected nominal wellbore pressure level is helpful when setting pressure thresholds, especially when using a multi-threshold pressure state detection. Expected nominal wellbore pressure levels may be set as part of a manual input process, or may be determined dynamically during operation. The expected wellbore nominal pressure levels may be different at different stages of the fracking operation. For example, there may be different expected wellbore pressures during wireline and fracking procedures. Furthermore, there may be different expected nominal pressures at different points in time during the different procedures. The pressure threshold(s) used by auto-detect tool 305 may then be based on these nominal pressure levels automatically or by user input. For example, the threshold between a low pressure state and a medium pressure state may be set somewhere (e.g. 500 psi) below the nominal pressure, while the threshold between a medium pressure state and a high pressure state may be set somewhere (e.g. 500 psi) above the nominal pressure.

Multi-Well Fracking Order

Based on detected closings and openings of valves 12, it is possible for auto-detect tool 305 to infer the fracking order when making state determinations. However, the fracking order is typically planned in advance and providing this knowledge a priori to auto-detect tool 305 will aid its ability to flag unexpected sequences of operation. It may additionally or alternatively be helpful in making some state estimates on one well due to activity on another well, for example, prepping a wellhead for pending arrival of the frac crew.

Wireline Crew Identification

When multiple wireline crews are used in a multi-well fracking operation, it may be helpful for auto-detect tool 305 to know which wells are serviced by each wireline crew. Often, each well is serviced by only a single crew. However, there are situations in which one or more of the wells in a multi-well operation can be serviced by more than one wireline crew.

Frac Crew Identification

Typically, there is only a single frac crew operating in a multi-well operation. In some embodiments, more than one frac crew can operate in a multi-well operation. The knowledge of which wells are serviced by which frac crew is helpful for auto-detect tool 305 to provide optimal monitoring. In some embodiments, it is possible that two or more wells are simultaneously fracked by a single frac crew. Knowledge of which wells are being fracked by that frac crew would similarly be useful to auto-detect tool 305.

Minimum Proppant Per Stage

Auto-detect tool 305 may be configured with, or to receive, information related to the minimum proppant per stage. By having knowledge of the minimum proppant per stage for a particular fracking operation, the auto-detect tool 305 can be configured to differentiate whether the frac pumping has stopped due to an unexpected situation, or whether pumping has stopped because fracking is complete for that stage. This knowledge of the minimum proppant can be verified against available 3$^{rd}$ party data providing a flow rate from the frac pumping provider.

Parameter Change Detection

In an ideal scenario, the initially defined frac parameters will remain unchanged over the course of the completions operation. Typically, such a scenario indicates that everything has gone according to plan. However, this is often not the case and auto-detect tool 305 may be able to accommodate changes to the original frac parameters. As an illustrative example, it may become necessary to deviate from the original multi-well/stage fracking order due to unexpected problems with one of the wells. Providing such information regarding parameter/procedure changes to auto-detect tool 305 enables tool 305 to adjust its expectations and provide a cleaner response to the user (e.g. fewer warning flags about unexpected operations).

Customer Operating Procedures

While there is often much commonality in plug & perf fracking operations amongst different fracking operators, auto-detect tool 305 may be able to accommodate a number of different operational details specific to different operators. Such details may be contained in customization rules 330 (FIG. 3). This additional apriori information may enable auto-detect tool 305 to better tolerate and adapt to events which deviate from a set of default operating procedures. For example, based on customer specific data, auto-detect tool 305 may be able to appropriately react to events such as a missing sensor input (e.g. due to a failed sensor 14), ignore mistakes by field crew in certain scenarios (e.g. when a wrong valve 12 is mistakenly opened then closed) or notify the field crew when an unexpected sequence of events has been detected to thus allow them to more quickly and safely take remedial action and/or the like.

As an illustrative example, the first stage of a wellbore to be fracked typically has a "toe" port and does not require wireline plug & perf to be performed before fracking can commence. However, a common variation preferred by some operators is to plug & perf the first stage before fracking, even though this operation may not strictly be required. Another example variation is that some operators choose to run the plug & perf tool on the next stage immediately upon completion of fracking the previous stage. In such scenarios, auto-detect tool 305 may assume that the wireline swapover state is immediately entered after fracking has completed and the wireline crew is available (the wireline crew may not have yet finished working on the previous well).

Wellhead Topology

Wellhead topology data 340 (FIG. 3) identifies the physical relationship of the valves 12, valve sensors 14 and pressure sensors 16 on each of the wells in a multi-well operation. Topology data 340 may be received by auto-detect tool 305 and may permit health status checks to be performed on sensors 14, 16, valves 12, and the wells themselves. For example, if it is known that a pressure sensor 16 is located between two valves 12 in series, then when both of those valves 12 are closed the observed pressure between those closed valves 12 should remain constant. However, if a change in pressure is detected while the surrounding valves 12 are closed, there is accordingly an indication of either a faulty pressure sensor 16 or a leaking valve 12. The detection of such information relating to other sensors 14, 16 and components is possible through topology data.

In some embodiments, the use of wellhead topology data 340 can be advantageously combined with 3$^{rd}$ party data 325. As an illustrative example, 3$^{rd}$ party data 325 may comprise pump-down and fracking pump rates. Wellhead topology data 340, in conjunction with 3$^{rd}$ party data 325, may allow for a real-time dynamic simulation of expected pressures to be generated. Such a dynamic simulation may be compared against observed pressure data 320. Discrepancies between the pressure simulation and observed pressure data 320 may identify potential health issues of the fracking system.

As another illustrative example, a leakage is detected in a valve 12 separating the wellbore from frac pressure. In this scenario the wellbore is closed, but another adjacent well is being fracked. Regularly, when a wellbore is closed, the pressure trapped within that wellbore slowly decays to a long-term steady state level over time. A perturbation to this decay trend when fracking starts on another well suggests the valve 12 separating adjacent wells may be leaking. Accordingly, depending on the wellhead topology, detecting a perturbation in the wellbore pressure decay at a particular location in the system may indicate that fracking of a neighbouring well may have penetrated into the current well of interest.

Operator Feedback

Given the complexity of operation of a multi-well plug & perf completions site combined with the possibility of fracking equipment failure and/or sensor failures due to harsh operating environments, there is a possibility that, from time to time, auto-detect tool 305 will be incorrect in its multi-well state determination. Thus, it is preferable that auto-detect tool 305 is able to accept feedback 345 from an operator (FIG. 3) to correct or adjust an incorrectly determined state. As the detected events and activities and the resulting state determination of one well can affect the state determination of other wells, an operator correction or adjustment 345 can have a complicated ripple effect if not designed properly. Thus, it may be preferable that auto-detect tool 305 shields the algorithmic complexities inherent to the correction process from the operator to simplify an eventual correction or adjustment to the provided state determination.

Activity State Detection Estimation (Single Well)

Particular embodiments of the present invention provide methods for determining an activity state for a single well which may be performed by auto-detect tool 305 using some or all of the data available to auto-detect tool 305. This may also be referred to herein as "single well detection". In some embodiments it is contemplated that multiple wells are fracked in multi-well completions configurations (such as that shown in FIG. 2). In such embodiments, multiple instances of single well detection methods can be utilized; one instance of the method for each well to obtain that specific well's activity state.

In some embodiments, the single well detection method uses plurality (e.g. two) of independent strategies/techniques for determining the well activity state Depending on the confidence level in the analysis performed by one or more of these strategies/techniques, the method can provide one or more appropriate recommendations. The confidence level of an analysis can be affected by the presence of operational issues. Non-limiting examples of operational issues which can affect the confidence level include whether one or more sensors are offline, impaired, or non-existent (e.g. a desired valve is not being monitored due to physical limitations imposed by the valve design), whether the detected event follows the expected sequence of operation for the specific customer, and/or the like.

Figure 5:
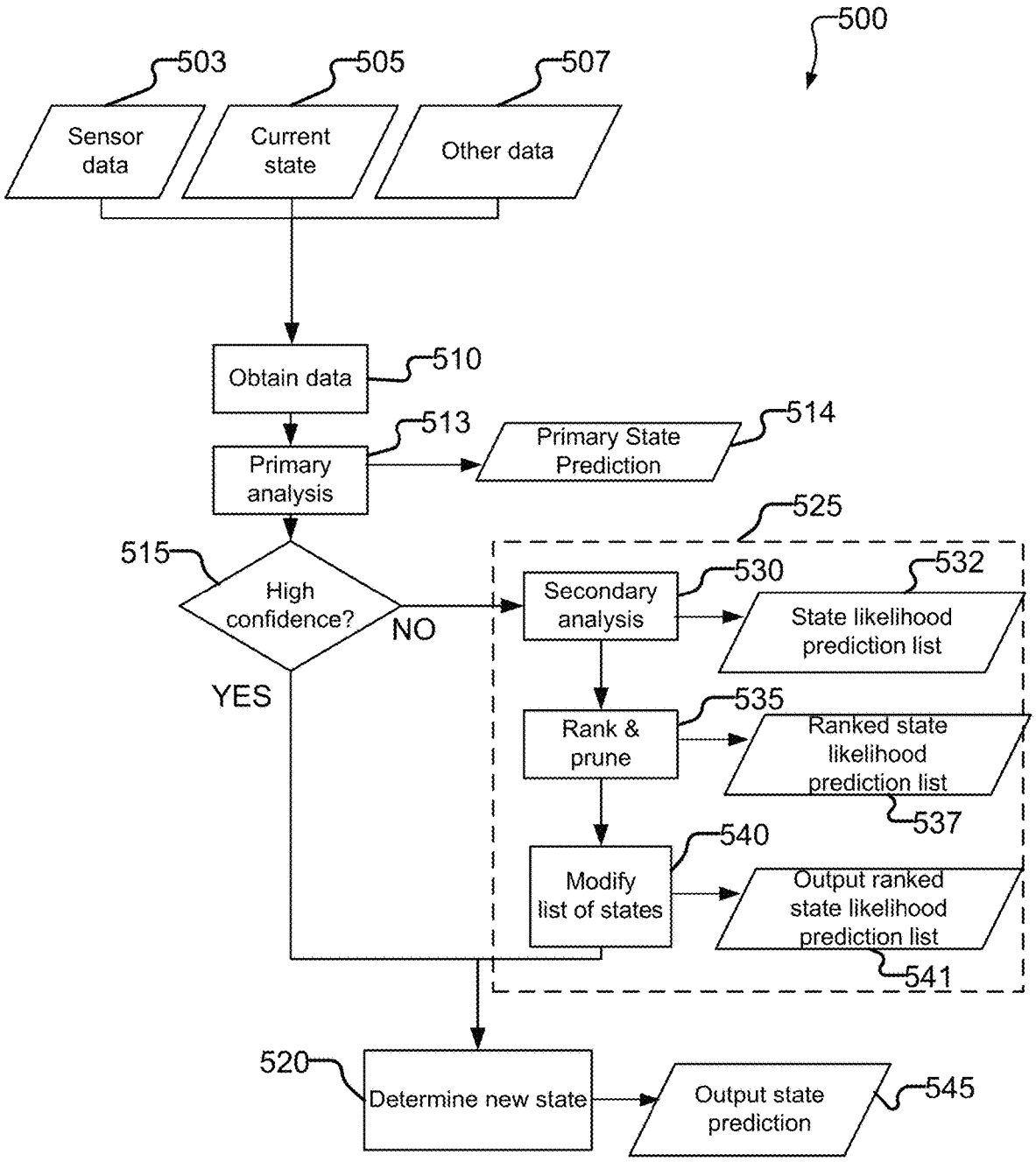
FIG. 5 is a flow diagram showing a basic dual-strategy analysis usable by an auto-detect system according to a particular embodiment.

FIG. 5 shows a block diagram of a single well detection method 500 illustrating an example dual-strategy analysis. In general, method 500 may be repeatedly executed with suitable time steps $\Delta_t$, where $\Delta_t$ may be on the order of 2 seconds or less, for example. Method 500 begins at block 510 which involves obtaining data and/or other inputs and/or information. As shown in FIG. 5, the data/inputs/information obtained in block 510 may comprise, without limitation, sensor data 503, a current state 505 of the well under consideration and other data 507. By way of non-limiting example, sensor data 503 may comprise valve position data 315, pressure data 320, third party sensor data 325 (see FIG. 3) and data from any other available sensors. Current state 505 obtained in block 510 may comprise, for example, a last state predicted by method 500 (e.g. in a previous iteration), a user state input, an initialization state and/or the like. As discussed further herein, a current state of well activity may inform how present observations and received data are interpreted. By way of non-limiting example, other data 507 obtained in block 510 may comprise some forms of third party data 325, customization rules 330, fracking parameters 335 and topology data 340. Data/input/information obtained in block 510 may generally be obtained in any suitable manner. Such data may be provided as an input to auto-detect tool 305 (e.g. as user input and/or input obtained via some suitable communication interface), hard-coded into auto-detect tool 305, calibrated into auto-detect tool, received in response to a query initiated by auto-detect tool 305 and/or the like.

Method 500 proceeds to block 513 where, based on data/inputs/information obtained in block 510 (including the current state 505), a primary analysis is performed to determine a predicted subsequent state 514 of well activity. This subsequent state prediction 514 determined in block 513 additionally comprises a confidence level in the predicted state 514. The confidence level of the predicted state 514 may consider any number of appropriate factors, including the example factors described above. The confidence level may be selected from among a discrete plurality of possible confidence levels. As an example, the confidence level can be of three levels: low, medium, or high. As another example, the number of the plurality of possible confidence levels can be less than or equal to ten. In some embodiments, the confidence level can be expressed as a floating point number in a range of 0-1.

Method 500 proceeds to decision block 515 which evaluates whether there is sufficiently high confidence in the block 513 primary predicted state 514. If the block 515 determination is positive (YES output), then method 500 proceeds to block 520. In some embodiments, decision block 515 evaluates as being positive if there is a medium or high confidence in predicted state 514. In other embodiments, block 515 evaluates positive only if the confidence level of predicated state is high. In some embodiments, decision block 515 evaluates as being positive if the confidence in predicted state 514 is greater than a configurable threshold. If the block 515 determination is negative (NO output), then method 500 proceeds to perform a secondary analysis at sub-process 525.

Sub-process 525 begins at block 530 by invoking a secondary state analysis routine which determines state likelihood prediction list 532. State likelihood prediction list 532 may comprise a list of a number of possible subsequent states and, for each subsequent state, a corresponding likelihood. That is, state likelihood prediction list 532 may comprise a number of possible subsequent states and a corresponding likelihood for each of those possible subsequent states. In contrast, the primary analysis at block 513 produces a single predicted state 514. Method 500 then proceeds to block 535, where state likelihood prediction list 532 is pruned (e.g. to remove states having a likelihood less than a configurable threshold) and sorted by likelihood, to arrive at a ranked state likelihood prediction list 537.

At block 540, ranked state likelihood prediction list 537 may be optionally be modified to provide output ranked state likelihood prediction list 541 prior to the completion of sub-process 525. According to an example embodiment, if the confidence level in the block 513 primary state prediction 514 is low, then the block 535 ranked state likelihood prediction list 537 is unchanged and forms the output ranked state likelihood prediction list 541 of sub-process 525. On the other hand, if the confidence level in block 513 primary state prediction 514 is medium, then primary state prediction 514 and its corresponding confidence level are added to ranked state likelihood prediction list 537 in block 540 and the ranked state likelihood prediction list 537 (so-modified) forms the output ranked state likelihood prediction list 541 of sub-process 525. According to another example embodiment, if the confidence level in the block 513 primary state prediction 514 is at or below a configurable first threshold, then the block 535 ranked state likelihood prediction list 537 is unchanged forms the output ranked state likelihood prediction list 541 of sub-process 525. On the other hand, if the confidence level in block 513 primary state prediction 514 is greater than the first threshold but less than or equal to a configurable second threshold (e.g. the block 515 threshold), then primary state prediction 514 and its confidence level may be appended to ranked state likelihood prediction list 537 in block 540 and the ranked state likelihood prediction list 537 (so-modified) forms the output ranked state likelihood prediction list 541 of sub-process 525.

Following block 540, sub-process 525 ends and method 500 proceeds to block 520, which involves determining a final well activity state prediction 545. Final state prediction 545 may be the output of method 500. In the case that the block 515 evaluation is positive, determining output state prediction 545 at block 520 simply comprises selecting primary state prediction 514 as output state prediction 545 and method 500 ends.

In the case that the evaluation at block 515 is negative, block 520 comprises an evaluation of the possible states of output ranked state likelihood prediction list 541 output from sub-process 525. In some embodiments, block 520 simply comprises selecting the first state from output ranked state likelihood prediction list 541 as the new well activity state 545 (the first state being ranked as the most likely state). In other embodiments, block 520 comprises seeking operator feedback or confirmation in determining the new state. For example, output ranked state likelihood prediction list 541 may be displayed to a user for selecting the next well activity state 545. The displayed list may comprise the possible state options on output ranked state likelihood prediction list 541, the likelihood of occurrence for each state, and reasons (logic) as to why each state is considered possible, for example. In this manner, a user can exercise judgement in selecting amongst different possible options if auto-detect tool 305 is not confident in its determinations. It is also possible that a user manually inputs a next state 545 that is not in output ranked state likelihood prediction list 541. In some embodiments, a suitable algorithm may consider output ranked state likelihood prediction list 541 and choose from amongst the states in output ranked state likelihood prediction list 541 based on any number of appropriate criteria.

The determination of a subsequent well activity state and its likelihood of occurrence based on a current state and sensed data (e.g. in block 513 and/or block 530) can be accomplished in a number of possible ways. Some examples are described below.

Primary Analysis

Figure 6:
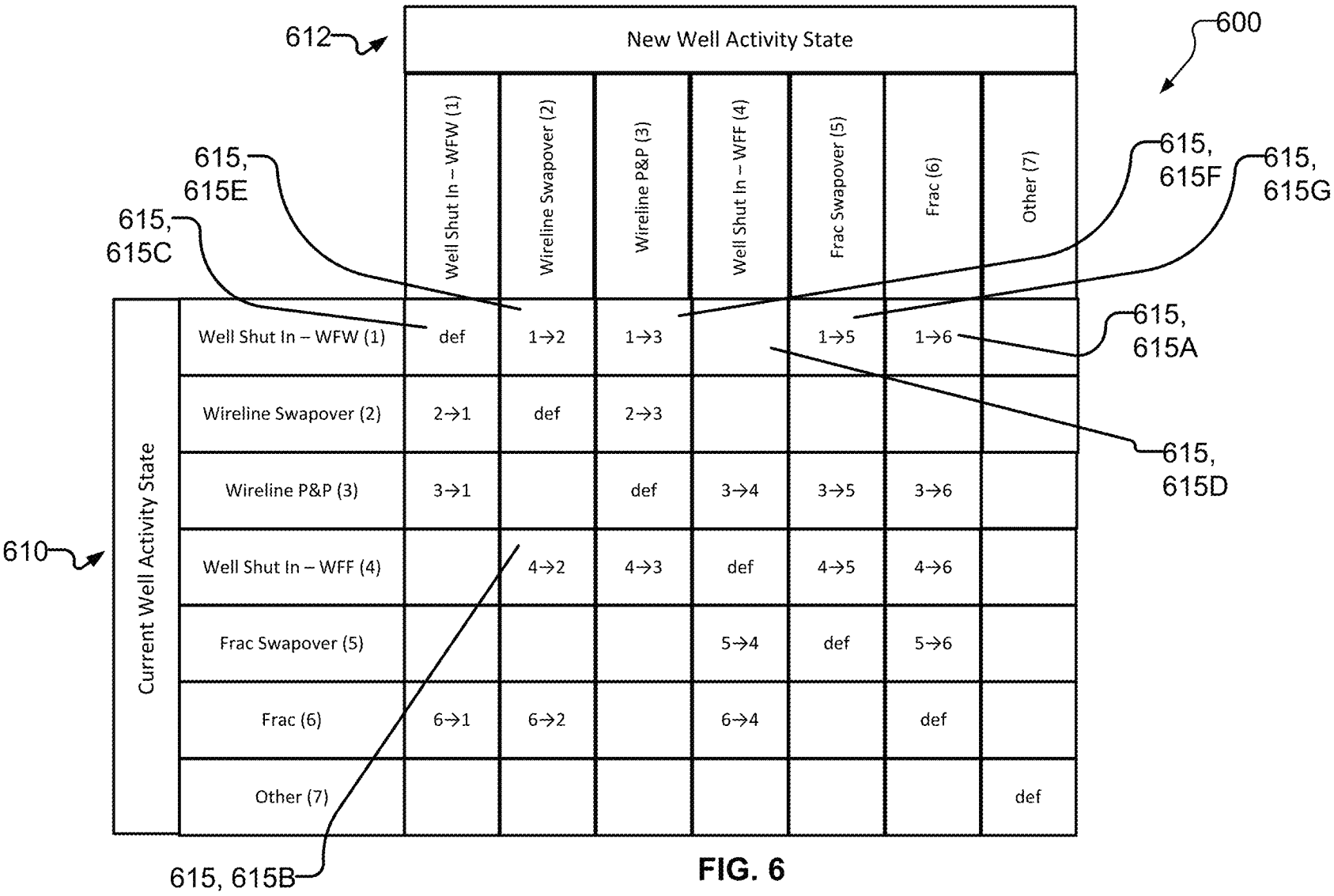
FIG. 6 is an exemplary 2D matrix of current well activity states and new well activity states and the transitions anticipated by the primary analyzer of the FIG. 5 auto-detect system.

As discussed above, block 513 (FIG. 5) involves conducting a primary analysis to ascertain primary state prediction 514 and its corresponding certainty level. In the FIG. 5 embodiment, the block 513 primary analysis has access to sensor data 503, a current state 505 and, optionally, other data 507. In some embodiments, this relationship may be embodied in a function which may be recorded as values in a lookup table, parameters of an equation or the like. FIG. 6 illustrates a non-limiting example of a 2D matrix 600 that can be used for the purposes of performing the block 513 primary analysis according to an example embodiment. Matrix 600 comprises rows indexed by a current well activity state 610 and columns indexed by a new well activity state 612. Each element 615 of the matrix represents a possible transition from a current well activity state 610 to a new well activity state 615. For example, matrix element 615A represents a change from current state 610 of "Well Shut In—WWF (1)" to a new state 612 of Frac (6), matrix element 615B represents a change from current state "Well Shut In—WFF (4)" to a new state 612 of "Wireline Swapover (2)".

Matrix 600 may have an equal number of rows and columns, determined by the number of defined well activity states 610, 612. In some embodiments, the defined states 610, 612 can be customer specific or can otherwise be configurable by customers. In the particular case of the exemplary matrix 600 shown in FIG. 6, matrix 600 comprises five well activity states 610, 612 of interest, with the "Well Shut In" state comprising two distinct sub-states. There is an additional "Other" state defined as a catch-all for other (e.g. undefined) states In some embodiments, the "Other" state supports a user manually overriding the block 513 primary analysis to define otherwise undefined states. The states illustrated in the exemplary FIG. 6 matrix 600 are:

Well Shut In:

Well Shut In—WFW (Waiting for Wireline)—(1);

Well Shut In—WFF (Waiting for Frac)—(4);

Wireline Swapover—(2);

Wireline P&P (Plug & Perf)—(3);

Frac Swapover—(5);

Frac—(6); and

Other (7).

The order in which these states appear in matrix 600 can be arbitrary. In some embodiments, a greater number of well activity states (or intermediate states) can be added to adequately capture the possible combination of events and conditions.

As discussed, each element 615 of matrix 600 represents a possible state change from current state 610 to a new state 612. Entries labelled "def" in the illustrated example matrix 600 imply a default condition. In the default condition, current activity state 610 remains unchanged (or is the same as the new state 612) until defined criterion (discussed more below) are met to signal a transition to a different activity state. So, for example, the matrix element 615C is labelled "def" to indicate that the current state 610 "Well Shut In—WFW (1)" remains (or is the same as the new state 612) until some defined criterion are met to indicate a possible state change. In the exemplary matrix 600 of FIG. 6, a number of cells 615 are empty. An empty cell entry implies that the block 513 primary analysis will not test for this transition, because a transition from the corresponding current state 610 to the corresponding new state 612 is very unlikely to occur. For example, in operation, it is highly improbable that an operation in a "Well Shut In—WFW (1)" current state 610 where the well is waiting for wireline operations to commence would transition to a new state 612 of "Well Shut In—WFF (4)", as this implies that the wireline operations have been skipped and that the well has proceeded immediately to waiting for fracking. Accordingly, cell 615D of matrix 600 is blank.

The remaining cells of matrix 600 of the illustrated embodiment have annotations "x→y" which represents a change in state from current state 610 "x" to new state 612 "y". For example, cell 615E contains the entry "1→2", which represents the possible transition from current well activity state 610 "Well Shut In—WFW (1)" to new well activity state 612 "Wireline Swapover (2)". Each matrix element 615 corresponding to a change from a current state 610 to a new state 612 and annotated by "x→y" may incorporate (e.g. using suitable software pointers and/or the like) one or more corresponding sets of events and conditions. When a particular set of events and conditions corresponding to a matrix element 615 and a corresponding state transition evaluate to be true, then the block 513 primary analysis may determine that the corresponding state transition is possible and may assign a confidence level to that state transition. In some embodiments, a confidence level may be preassigned to each set of events and conditions. In some embodiments, a confidence level may be determined dynamically (e.g. based on the same events and conditions and/or other events and conditions available to auto-detect tool 305).

Each matrix element 615 corresponding to a change from a current state 610 to a new state 612 and annotated by "x→y" may incorporate (e.g. using suitable software pointers and/or the like) one or more corresponding sets of events and conditions. As discussed above, events may comprise: particular valve(s) 12 open, particular valve(s) 12 closing, particular valve(s) 12 being greased, particular valve(s) 12 transitioning; particular valve sensors (14) going offline, particular valve sensor(s) (14) going online, readings from pressure sensor(s) 16 crossing thresholds (including with possible dwell time criteria) and/or the like. Conditions may comprise any conditions evaluatable by auto-detect tool 305 based on its inputs or other information available to it.

In a current example embodiment, each matrix element 615 may be associated with one or more sets of events and conditions, and each set of events and conditions comprises a single event and any suitable number (including zero) of conditions. While it is possible to define multiple combinations of events and conditions within a set, it is often desirable to define single event criterion and to sequentially consider each event.

The following table illustrates example sets of event criterion, conditions, and confidence levels associated with transition from state Well Shut IN—WFW (1) to state Wireline Swapover (2) corresponding to matrix element 615E in the illustrated example matrix 600.

TABLE I example events and conditions signalling a potential transition from state Well Shut IN - WFW (1) to Wireline Swapover (2)

| Event | Condition(s) | Confidence |
|---|---|---|
| Swab valve group 12G opens | N/A | High |
| Wellhead pressure 16B goes high | Swab VPS group 14G is offline or absent AND Frac VPS group 14E, 14F is offline or absent | Medium |

Referring to Table I, when in well activity state Well Shut In—WFW (1), the opening of the swab valve group 12G is expected. Thus, when this event is detected, there is a correspondingly high confidence level that the new well activity state is Wireline Swapover (2) without the requirement for any other conditions to be met. In the second row of Table 1, data in respect of swab valve 12G is not detected (e.g. VPS 14G is offline or otherwise not reporting) and so the detection of swab valve 12G opening is not detected. However, if however, an event is detected that the wellhead pressure measured by 16B goes high and there are conditions that there is no reporting from both swab VPS 14G of the swab valve group 12G and frac VPS 14E, 14F of the frac valve group 12E, 12F then a possible state change from Well Shut IN—WFW (1) to Wireline Swapover (2) may be predicted with a medium confidence level.

As another illustrative example, cell 615F contains the entry "1→3", which represents the possible transition from well activity state Well Shut In—WFW (1) to well activity state Wireline P&P (3). The following table provides three sets of example events, conditions, and confidence levels for this transition and may be associated with cell 615F for use by auto-detect tool 305 in performing the block 513 primary analysis.

TABLE II example events and conditions signalling a potential transition from state Well Shut In - WFW (1) to Wireline P&P (3)

| Event | Condition(s) | Confidence |
|---|---|---|
| Master valve group 12A, 12B opens | Frac valve group 12E, 12F is closed AND swab valve group 12G is offline or open | High |
| Master valve group 12A, 12B opens | Frac valve group 12A, 12B is offline AND swab valve group 12G is open | High |
| Master valve group 12A, 12B opens | Swab valve group 12G is offline AND Frac valve group 12A, 12B is offline | Medium |

Normally this transition from state Well Shut In—WFW (1) to Wireline P&P (3) is not expected, as the normal sequence of events would be from state Well Shut In—WFW (1) to Wireline Swapover (2). As discussed above, the opening of the swab valve group 12E is normally the event which signals the transition from state (1) to (2) (see first entry of Table I). However, if the swab valve group 12E is not being monitored (or is offline) and a pressure test was not conducted, the transition from state Well Shut In—WFW (1) to Wireline Swapover (2) would not be detected. Thus, under such circumstances, when the master valve group 12A, 12B opens, the transition from state Well Shut In—WFW (1) to Wireline P&P (3) may be detected. As shown in Table II, the confidence levels for detecting this particular transition vary depending on the conditions that are satisfied, which in turn depend on the particular status of the frac valve group 12E, 12F and the swab valve group 12G.

As another example, cell 615G corresponds to the transition from well activity state Well Shut In—WFW (1) to well activity state Frac Swapover (5), and is not normally expected, as this implies that wireline operations were bypassed before proceeding to fracking activities. However, as shown by the presence of the "1→5" entry in cell 615G, this scenario may be allowed in some specific situations. A transition from state Well Shut In—WFW (1) to well activity state Frac Swapover (5) would imply that the current well activity state 610 is incorrect and that the current state 610 should instead have been well activity state Well Shut In—WFF (4). Table III below shows an example set of event criterion, conditions, and confidence levels for this transition, and which may be associated with cell 615G.

TABLE III

| example events and conditions signalling a transition from state Well Shut In - WFW (1) to Frac Swapover (5) | | |
|---|---|---|
| Event | Condition(s) | Confidence |
| Wellhead pressure 16A goes high | Frac valve group 12E, 12F is open | Medium |
| Frac valve group 12E, 12F opens | | Low |

Referring to the first row of Table III, a pressure rise detected in the wellhead (sensor 16A) while the frac valve group 12E, 12F is open suggests that a fracking pressure test could be in progress, resulting in a medium confidence determination that a transition from state Well Shut In—WFW (1) to Frac Swapover (5) is occurring. Referring to the second row of Table III above, the opening of the frac valve group 12E, 12F while the current state is Well Shut In—WFW (1) could have been an operational mistake, as this action is not typically performed while awaiting wireline operations. Thus, the confidence level of this transition from t Well Shut In—WFW (1) to Frac Swapover (5) based on this event (the opening of the frac valve group 12E, 12F) is low.

Cell 615A corresponds to a transition from state Well Shut In—WFW (1) to well activity state Frac (6) and is not expected, but may be allowed under specific situations as shown by the presence of the entry "1→6" in cell 615A. A successful transition from Well Shut In—WFW (1) to well activity state Frac (6) implies that the current well activity state 610 is incorrect and should have been well activity state Well Shut In—WFF (4) or Frac Swapover (5). Table IV below shows a number of example sets of events, conditions and confidence levels that may be associated with in cell 615A.

TABLE IV

| example events and conditions signalling a potential transition from state Well Shut In - WFW (1) to Frac (6) | | |
|---|---|---|
| Event | Condition(s) | Confidence |
| Wellhead pressure 16A goes high | Frac valve group 12E, 12F is open AND Master valve group 12A, 12B is open | Medium |
| Master valve group 12A, 12B opens | Frac valve group 12E, 12F is open | Medium |

It will be appreciated that the events, conditions and/or confidence levels associated with cells 615 described herein serve merely as illustrative examples and that modifications to the example events, conditions and/or confidence levels associated with cells 615 are possible. For example, cell 615G may additionally include the criteria of the master valve group 12A, 12B being closed as indicating a transition from state Well Shut In—WFW (1) to Frac Swapover (5) can be added. However, this is likely redundant in this particular scenario as the opening of the master valve group 12A, 12B would have previously been detected and the current state would unlikely be Well Shut In—WFW (1).

Although example events, conditions and confidence levels are only described for matrix 600 for state transitions originating from current state 610 corresponding to Well Shut In—WFW (1), it will be appreciated that the specification of events, conditions and confidence levels for all other state transitions may follow the same form as the above examples.

In the exemplary FIG. 6 matrix 600, the row/column corresponding to the well activity state Other (7) does not have any defined transition criterion other than "default". This implies that auto-detect tool 305 will not automatically transition to the Other (7) state, nor will auto-detect tool 305 return from this state. However, it is possible to define criterion by which auto-detect tool 305 exits from the Other (7) state into one of the other defined states. For example, if the wellhead pressure (valve 12A) is detected as being high and the master valve group 12A, 12B is open, this may be considered likely that fracking or wireline activity has resumed. Thus, in some embodiments, auto-detect tool 305 may automatically exit from the Other (7) state to transition to a new well activity state upon certain events and/or conditions being satisfied.

Figure 6A:
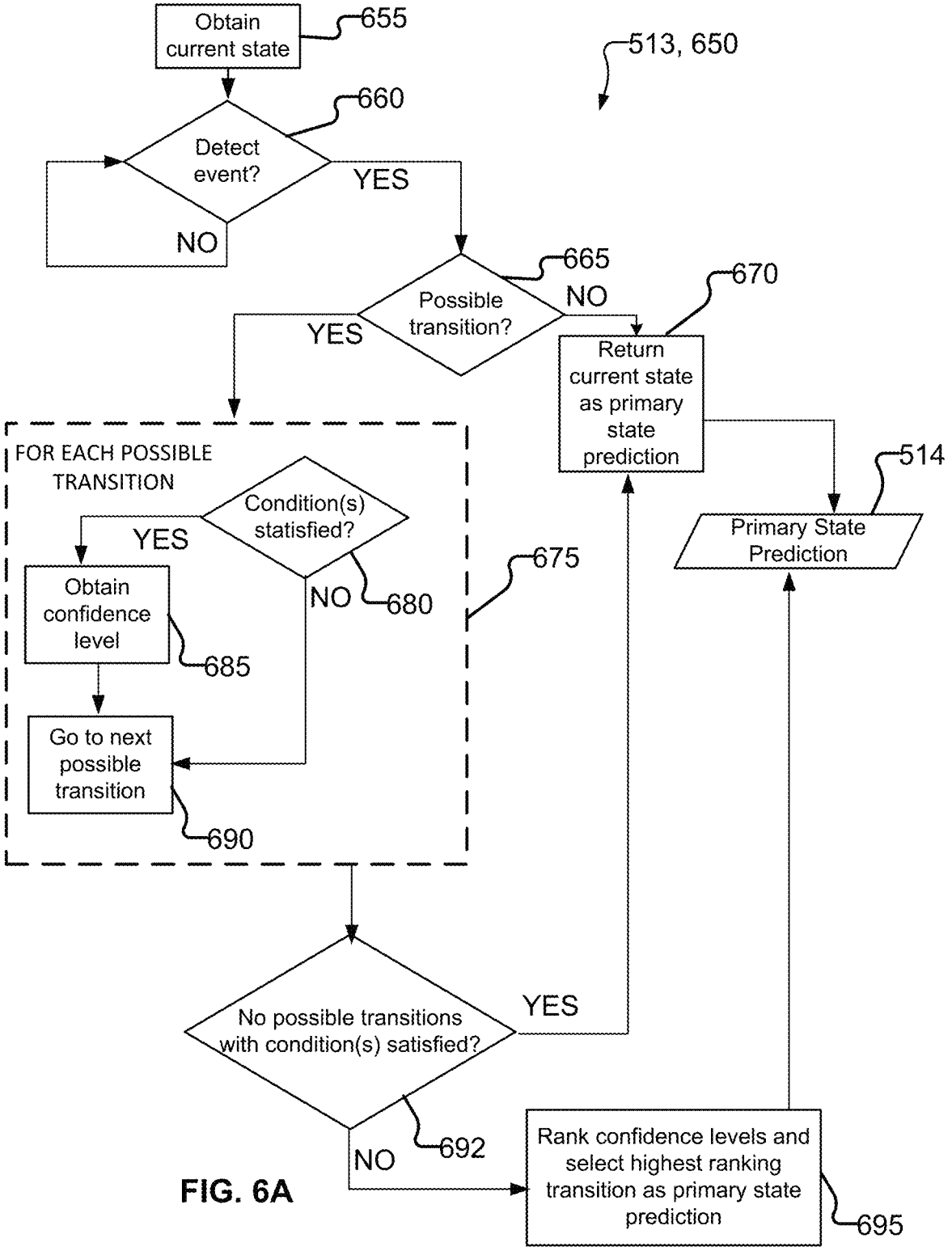
FIG. 6A shows a method for performing the primary analysis using the FIG. 6 example matrix according to an example embodiment.

FIG. 6A shows a method 650 for performing the block 513 primary analysis using the FIG. 6 example matrix 600 according to an example embodiment. Method 650 starts in block 655 which involves determining the current state. The current state may be determined in block 655 based on any suitable technique, including, without limitation, from output state prediction 545 from a last iteration of method 500 (FIG. 5), from user input, from an initialization routine and/or the like. The current state determined in block 655 corresponds to a current state 610 (i.e. a row) of matrix 600. Method 650 then proceeds to block 660 which involves waiting for an event to occur (be detected). By way of non-limiting example, as discussed above, auto-detect tool 305 may consider events to include, without limitation: example, the opening of valve(s) 12; the closing of valve(s) 12; valve(s) 12 being greased; valve(s) 12 being in transition from being open or closed or being greased to a different one of these states; valve sensor(s) going offline; valve sensor(s) 14 going online; pressure detected by pressure sensor(s) 16 crossing one or more configurable pressure thresholds (including with possible incorporation of dwell time); events based on third party data (e.g. a flow rate from the frac pumping provider crossing a configurable threshold; a flow rate from the pump down pumping provider crossing a configurable threshold; proppant concentration crossing a configurable threshold); events based on the expiry of configurable timers, other "soft" events described herein, events based on any of the other information shown in FIG. 3 (e.g. customization rules 330, fracking parameters 335, topology data 340, operator feedback 345), combinations of any of the foregoing and/or the like.

As discussed above, auto-detect tool 305 may be primarily concerned the detection of primary events in block 660, whereas secondary events may be considered to be of lower interest to the algorithm. As an illustrative example, if auto-detect tool 305 determines that one or more valves are in transition between an open and closed state (which is categorized as a secondary event), then the block 660 inquiry can be negative. In this manner, auto-detect tool 305 may wait until definitive valve positions are detected (e.g. valve becomes fully open) or an event classified as a primary event occurs before making any determinations on likely state transitions (e.g. before outputting a primary state prediction 514).

When an event is detected (block 660 YES output), method 650 proceeds to block 665 which involves determining if there is a potential transition based on the block 660 detected event. Considering the exemplary matrix 600 of FIG. 6, block 665 may involve considering the row of matrix 600 corresponding to the block 655 current state 612 and locating any matrix elements 615 in this row that have associated set(s) of event(s) and conditions corresponding to the block 660 detected event. If none of the possible state transitions (matrix elements 615 in the row corresponding to the current state) have associated events corresponding to the block 660 detected event (corresponding to block 665 NO branch), then method 650 proceeds to block 670 which involves returning the current state to be the primary state prediction 514 (see also FIG. 5). In some embodiments, block 670 may involve assigning a configurable confidence level (e.g. medium or 0.5) to primary state prediction 514. If, on the other hand, any of the possible state transitions (matrix elements 615 in the row corresponding to the current state) have associated events corresponding to the block 660 detected event (block 665 YES branch), then method 650 proceeds to block 675.

Block 675 is a loop that may be performed for each possible transition for which the block 665 inquiry is positive. In some instances, a single matrix element 615 can be positive for more than one reason. That is, each matrix element 615 can have multiple sets of associated event(s) and condition(s). Each such set of associated event(s) and condition(s) can be a possible transition for which the block 665 inquiry is positive. The block 675 loop is performed for each possible transition and starts in block 680 with an inquiry into whether the condition(s) associated with the current possible transition are satisfied. If NO, then loop 675 proceeds to block 690 where the process starts again for the next possible transition. If the block 680 inquiry is positive (i.e. the conditions associated with the current possible transition are satisfied), then the corresponding confidence level for the possible transition is obtained in block 685 before proceeding to block 690 where the process starts again for the next possible transition. As discussed above, each set of event(s) and condition(s) may be associated with a confidence level or with a technique for ascertaining the confidence level (which technique may be based on other inputs or data—see FIG. 3).

At the conclusion of loop 675, method 650 proceeds to block 692. Block 692 involves inquiring as to whether there are no possible transitions with their conditions satisfied. If the block 692 inquiry returns a positive result (YES branch), then method 650 proceeds to block 670 which, as discussed above, involves returning the current state to be the primary state prediction 514. In some embodiments, block 670 may involve assigning a configurable confidence level (e.g. medium or 0.5). If, on the other hand, the block 692 inquiry is negative (NO branch), then method 650 proceeds to block 695. Block 695 comprises ranking the possible transitions by their confidence levels and selecting the transition with the highest confidence level to be the primary state prediction 514. If the block 695 ranking process results in multiple possible state transitions having the same degree of confidence, a suitable tie-breaking criteria may be invoked, or the choices of possible transitions may be presented to an operator to make a final determination. The tie-breaking criteria may be based, for example, on one or more of the current state, the block 660 event and or any of the data shown in FIG. 3.

Secondary Analysis

Referring to FIG. 5, a secondary analysis may be performed at block 530 of method 500 in circumstances where a confidence level in the block 513 primary state prediction 514 is not sufficiently high. In some embodiments, the block 530 secondary analysis may ignore historical knowledge of the well activity state (e.g. current state 505 from FIG. 5) and uses sensor data 503 and/or other data 507 (e.g. $3^{rd}$ party data 325 from FIG. 3) to determine state likelihood prediction list 532.

By employing different methodologies in determining state likelihood prediction list 532 in the block 530 secondary analysis, different options which may have not been suggested by the block 513/method 650 primary analysis may be available for consideration.

Figure 7:
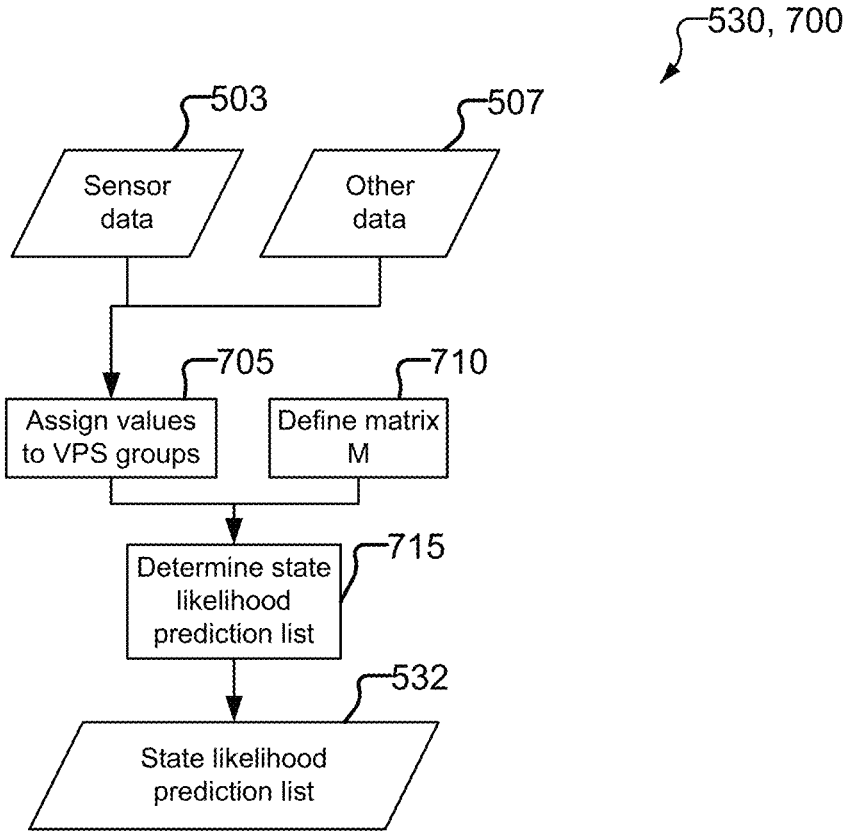
FIG. 7 is a block diagram showing an example method for performing a secondary analysis in determining a next well activity state.

FIG. 7 shows a block diagram of a secondary analysis method 700 that may be used to perform the block 530 secondary analysis and to determine state likelihood prediction list 532 (FIG. 5) according to a particular example embodiment. Method 700 accepts sensor data 503 and other data 507 as inputs.

Method 700 commences at block 705, which comprises assigning numerical values to various groups of valve 12 which are part of the well based on their detected positions, as detected by their corresponding VPS 14. According to a non-limiting example embodiment, a secondary analysis may be performed based on the status of the master valve group (e.g. valves 12A, 12B as detected by their corresponding VPS 14A, 14B from the FIG. 1 example wellhead 10), swab valve group (e.g. valve 12G as detected by VPS 14G), and frac valve group (e.g. valves 12E, 12F as detected by their corresponding VPS 14E, 14F). These valve and VPS groups will be used for illustrative purposes in describing method 700. In some embodiments, the following values are assigned to each valve group depending on the output from their corresponding VPS(s):

0=valve group closed
2=valve group potentially closed
3=VPS offline
4=valve group potentially open
6=valve group open Thus, in the illustrative example of the three valve groups (master valve group, swab valve group and frac valve group), a 3-element row vector of values based on the detected valve group states can be constructed. An example row vector determined at block 705 may take the following form:

$$VS=[\text{Master valve group},\text{Swab valve group},\text{Frack valve group}] \quad (1)$$

At block 710, a matrix M is defined. Matrix M has dimensions of m×n, where m is the number of defined possible states for a particular well and n is the number of valve groups under consideration. In currently preferred embodiments, there is a correspondence between well activity states considered by the block 513 (method 650) primary analysis and the m states considered as part of the block 530 (method 700) secondary analysis, although this correspondence is not necessary. According to an illustrative example embodiment where m=5, the m states comprise: Well Shut In, Wireline Swapover, Wireline P&P, Frac Swapover and Frac. These m states are similar to the states 610, 612 shown in matrix 600 and described above in the context of method 650, except that: (i) the m states used in secondary analysis method 700 do not include an "other" state; and (ii) the m states used in secondary analysis method 700 use only a single Well Shut In state (as opposed to Well Shut In—WFW (1) and Well Shut In WFF(4) used in method 650) since secondary analysis method 700 does not use historical knowledge of recent operation (i.e. current state 505) and, consequently, it is more difficult to determine whether a closed well is awaiting wireline or fracking operations. Thus, for the purpose of secondary analysis method 700 of the illustrated embodiment, each Well Shut In sub-state may be assumed to have the same likelihood of occurrence.

The values of the block 710 matrix M are defined based on the expected valve positions of each of the m states. As an illustrative example, in the Well Shut In state, all of the VPS groups corresponding to master valve group, swab valve group and frac valve group are expected to return readings of closed, or 0. Thus, the row of matrix M corresponding to the Well Shut In state should accordingly be [0, 0, 0] (see first row of the example matrix M defined in equation (2) below). As another example, in the Frac state, the master VPS group and frac VPS group are expected to return readings that their respective valve groups are open, or 6, while the swab VPS group is expected to return a reading that its corresponding valve group is closed, or 0 (see fifth row of the example matrix M defined in equation (2) below). Based on the above ordering of the m states and n VPS groups, an example matrix M may contain the following values:

$$M = \begin{bmatrix} 0 & 0 & 0 \\ 0 & 6 & 0 \\ 6 & 6 & 0 \\ 0 & 0 & 6 \\ 6 & 0 & 6 \end{bmatrix} \tag{2}$$

Upon the completion of blocks 705 and 710, method 700 proceeds to block 715 where the rankings for the m different possible states are determined to arrive at state likelihood prediction list 532. As discussed above, state likelihood prediction list 532 may comprise a ranking of the m possible states. In some embodiments, such state rankings may be determined, for each state, based on determining a degree of difference between a detected position of each valve group (based on signals from their corresponding VPS) compared to the expected valve group readings for that particular state. The computation of state rankings at block 715 may take the form:

$$R_i = \sum_j abs(M_{i,j} - VS_j) \tag{3}$$

Where: i is the state currently being considered; j is the index of a particular valve group (e.g. as defined in Equation (1)); $M_{i,j}$ is the expected value of the $j^{th}$ valve group for the $i^{th}$ state; and $VS_j$ is the measured state of the $j^{th}$ valve group as determined from the corresponding h VPS. Evaluation of Equation (3) results in $R_i$, which provides a ranking value for the likelihood of occurrence of the $i^{th}$ state. A lower value of $R_i$ indicates that there is a higher likelihood of that $i^{th}$ state occurring. Once the $R_i$ are determined for each of the m possible states, then the states may be ranked in a list according to lowest $R_i$ (corresponding to highest likelihood) and output as state likelihood prediction list.

It will be appreciated that the particular numerical values (discussed above) for the statuses assigned to the valve groups, the parameters of the row vector VS (equation (1)), and the parameters of the matrix Mare all given here as an illustrative example of an embodiment of the block 530 secondary analysis. Different values could be used based on the parameters detectable by the auto-detect tool 305, the nature of the operation site, and the anticipated probabilities of given states based on the possible statuses. As an example, sensed pressure data (e.g. from the various pressure transducers 16 in the FIG. 1 embodiment) may be used in conjunction with or as an alternative to the data obtained from VPS 14 described above.

The above description of secondary analysis (block 530, FIG. 5; method 700, FIG. 7) is an effective method when particular sensor inputs are required to be in certain states before drawing conclusions about possible state predictions. For example, a wireline plug & perf tool run cannot happen unless both of the swab valves 12G and master valves 12A, 12B are open. However, there are other sensor input(s) that may increase the confidence in a possible state prediction when such sensor(s) are determined to be in specific state(s), but do not degrade the confidence in a state prediction when such sensor(s) are determined to be in different state(s). For example, a detected high well-bore pressure (pressure sensor 16A or 16B of FIG. 1) adds to the confidence of a predicted state being fracking when the frac valves 12E, 12F are open and swab and pump-down valves 12G, 12C are closed. However, the absence of detecting a high pressure state at well-bore pressure sensor(s) 16A, 16B does not degrade the confidence of the predicted state being fracking. It could be, for example, that frac pumping simply has not yet started.

Returning to FIG. 5, as discussed above, state likelihood prediction list 532 generated by secondary analysis (block 530) may be modified by primary state prediction 514 generated by primary analysis (block 513) to generate output ranked state likelihood prediction list 541. In general, any suitable ranking criteria or technique may be used to perform this block 540 modification. For example, in embodiments using a three tier confidence level (high, medium and low), then method 500 may only end up in block 540 where primary state prediction 514 has a confidence ranking of medium or low. In such cases, a suitable ranking of state likelihoods could be (in descending order of confidence levels): state(s) with high confidence from state likelihood prediction list 532; primary state prediction 514 with medium confidence (if applicable); state(s) with medium confidence from state likelihood prediction list 532; primary state prediction 514 with low confidence (if applicable); state(s) with low confidence from state likelihood prediction list 532. In embodiments which use different confidence levels, other suitable rankings may be applied. In some embodiments, it may be desirable to provide primary state prediction 514 with some weight that might result in ranking primary state prediction 514 higher in output ranked state likelihood prediction list 541 than the state(s) of state likelihood prediction list 532 with similar level(s) of confidence. That is, the block 540 modification might provide some ranking preference to primary state prediction 514 over state(s) with similar confidence levels predicted by secondary analysis 530. This is not necessary, however.

Multi-Well Detection

Method 500 (FIG. 5) provides a method for predicting the state (output state prediction 545) for a single well (an exemplary one of which is shown n FIG. 1). In some embodiments, a multi-well auto-detect tool 805 (FIG. 8) may be used to predict the states of multiple wells in a multi-well system (e.g. as shown in FIG. 2). In such embodiments, multi-well auto detect tool 805 may obtain data, parameters, etc. (e.g. as shown in FIG. 3) from each of the multiple wells and may also obtain topology data 340 (or other data or parameters) that may be relevant to the multi-well system. Multi-well auto-detect tool 805 may be implemented by one or more suitably programmed computer(s)/processor(s)/controller(s) and/or the like 306 similar to processor 306 used to implement single-well auto detect tool 305 (FIG. 3). Additionally, the simultaneous tracking of multiple wells may, in some embodiments, permit multi-well auto-detect tool 805 to provide time-based tracking of activities corresponding to a well which are not necessarily indicated by detectable events on a given well.

Furthermore, in some embodiments, multi-well detection tool 805 may be able to prevent the possibility of conflicting events on the multiple wells. For example, with a single frac crew at a wellsite (as is typical in many scenarios) only one well is typically fracked at a time. In such a scenario, using a single-well detection approach (e.g. multiple independent single well auto-detection methods similar to method 500 of FIG. 5), it is possible for the independent auto-detect methods to erroneously determine that multiple wells are each performing fracking activities (either swapover or active fracking) concurrently. However, a multi-well detection tool that incorporates data from the multiple wells in a system may prohibit a prediction where multiple wells are predicted to be in a fracking state. This may be done by implementing conflict resolution rules, such as allowing the well having the highest confidence level in its state prediction to take precedence over the state prediction for other wells.

Furthermore, in some embodiments, multi-well auto-detect tool 805 can provide a greater tolerance to unexpected valve activity. For example, suppose there are 3 active wells on a site, one currently being fracked and two having been wirelined (plug & perf). Typically there is a defined sequence of fracking for the multiple wells. The sequence of fracking may be provided, for example, through 3$^{rd}$ party input 325 (see FIG. 3). In such a scenario, multi-well auto-detect tool 805 may know which of the two closed wells is next to be fracked. Thus, if the frac valve for the other well (i.e. the well not expected to be fracked next) is accidently opened, multi-well auto-detect tool 805 can detect this sequence error and flag the operator appropriately.

Figure 8:
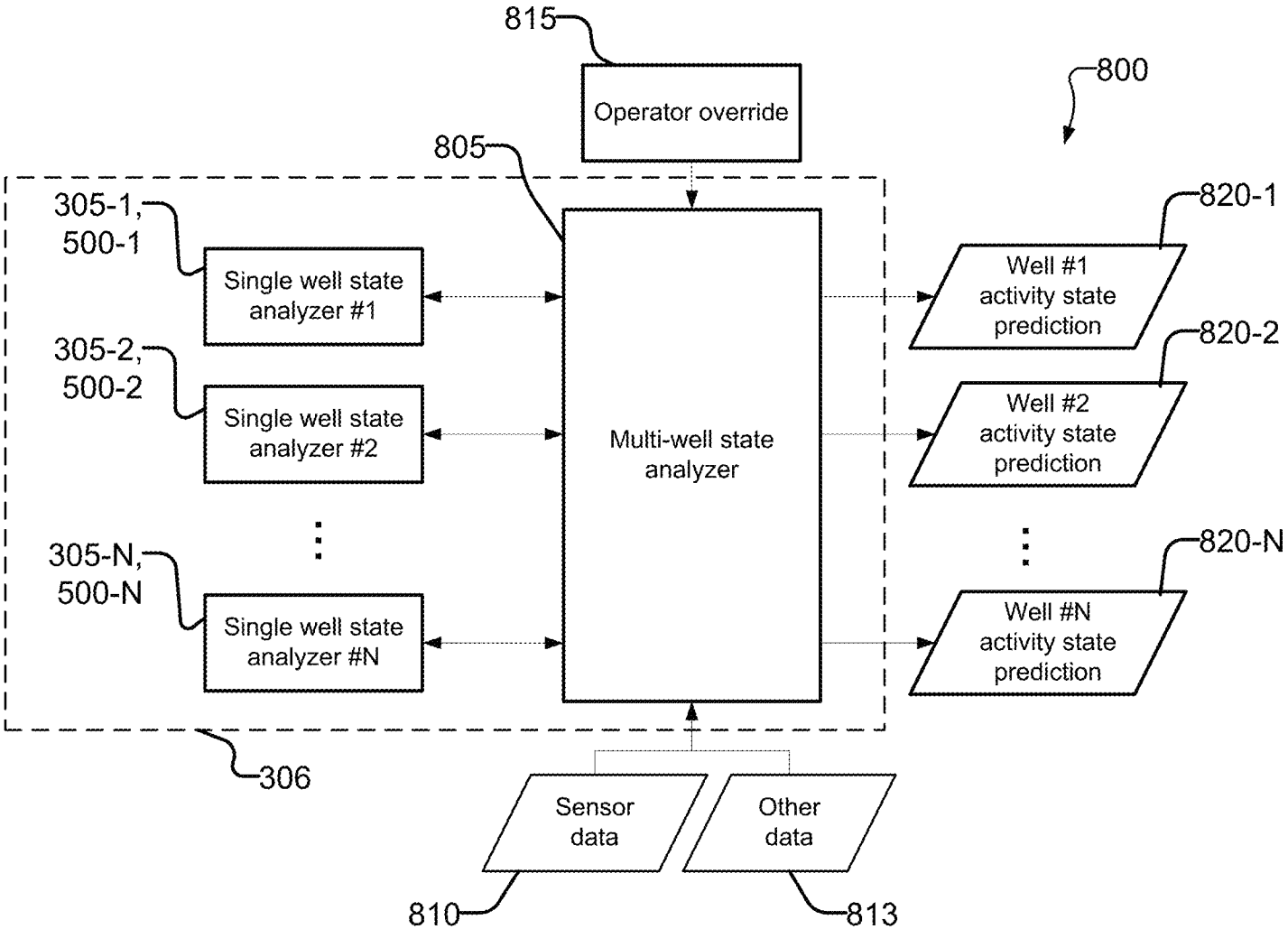
FIG. 8 is a chart showing the relationship between single well state analyzers and a multi-well state analyzer in an embodiment of a multi-well detection system.

In some embodiments, the methods for multi-well state detection build upon the single-well state detection method 500 described above. FIG. 8 is a schematic illustration which shows a diagrammatic representation of an example relationship 800 between single well state detection tools 305-1, 305-2, . . . 305-N (collectively, single well state detection tools 305) and their corresponding single well state-detection methods 500-1, 500-2, . . . 500-N (collectively, single well state detection methods 500) and a multi-well auto-detection tool 805 according to a particular example embodiment. Multi-well tool 805 and single-well state detection tools 305 may be implemented by suitably programmed computers/processors/controllers and/or the like 306 (see FIG. 3). As shown in the illustrated FIG. 8 example, multi-well auto-detect tool 805 interfaces with N copies of single-well state detection tools 305, each of which performs a corresponding single well state detection method 500 (where N is the number of wells). As discussed in relation to method 500 of FIG. 5, well-specific sensor data 503, current well state 505 and other data 507 (e.g. as shown in FIG. 3, for example) may be provided to each single-well state detection tool 305 and each single-well state detection tool 305 may independently perform a state detection method 500 to determine a state prediction 545 (FIG. 5) for its corresponding well.

Multi-well state analyzer 805 receives a state prediction 545 from each of single-well auto detect tools 500 and may analyze and accept or rejects these state predictions 545. As discussed above, the multi-well state analyzer 805 has the ability to override the state predictions 545 indicated by individual auto-detect tools 305, where a conflict or inconsistency is found (e.g. by applying appropriate conflict resolution rules). In some embodiments, where the state of a well determined by the multi-well auto-detect tool 805 differs from the state prediction 545 of a single-well auto-detect tool 305, the multi-well auto-detect tool 805 may cause the corresponding single-well auto detect tool 305 to adjust its internal state prediction to align with that of multi-well auto-detect tool 805.

Multi-well state analyzer 805 of the FIG. 8 example embodiment additionally receives sensor data 810 and other data 813. In some embodiments, sensor data 810 may comprise sensor data 503 that is provided to each single-well auto-detect tool 305. In some embodiments, sensor data 810 may additionally comprise data that may be common to some of the multiple wells, such as, by way of non-limiting example: the pressure in frac manifold 23A (e.g. as measured by pressure sensor 16D (FIG. 1), the pressure in pump down manifold 21A (as measured by pressure sensor 16C) and/or the like. As discussed above, other data 813 may comprise the fracking sequence and other operating parameters relevant to the operation of a multi-well wellsite.

In some embodiments, a manual operator override 815 may be applied to multi-well auto-detect tool 805. As an illustrative example, an operator may elect to perform an override 815 when key sensors fail, when well state auto-detect tools 305 and/or 805 make a state prediction known to be incorrect, when a situation occurs that is not detectable by well state auto-detect tools 305 and/or 805. Where an operator override 815 is applied, there may be potential ramifications on interrelated activities across the multiple individual wells. Thus, the application of an operator override 815 to multi-well auto-detect tool 805 may impact state predictions for each individual well. These impacts may accordingly be propagated to each single well auto-detect tool 305.

Multi-well auto-detect tool 805 may output well activity state predictions 820-1, 820-2, . . . 820-N (collectively, state predictions 820) for each of the N wells of the multi-well system based on the analysis and inputs described above.

The benefits of a multi-well auto-detect tool 805 versus a single-well auto-detect tool 305 can be illustrated by the following example. Consider an example three-well site, where each wellhead does not have frac valves connecting the wellhead to a common frac manifold. In such an example, when the frac crew moves from well to well, the piping from the fracking pumps is manually rerouted from the most recently fracked well to the next well to be fracked. Similarly, pipes may have to be manually rerouted from well to well for wireline operations. It may be of interest to the organization operating the multi-well system to track the time required for performing these manual pipe reroutings.

The exclusive use of single-well activity auto-detect tools 305 would not detect the start of fracking activities (Frac Swapover) until a pressure test was performed on the next well to be fracked, indicated by a pressure rise in the wellhead and combined with the condition that the swab valve was closed. Similarly, the exclusive use of single-well activity auto-detect tools 305 would not detect the start of wireline activities (WirelineSwapover) until a pressure test was done. These limitations may be apparent where there is a company safety policy that no personnel are allowed to approach any of the wellheads when fracking activity has commenced on any one of the wells, for example. Accordingly, compliance with this policy may be difficult in scenarios where only single-well auto-detect tools 305 are employed. In contrast, the use of multi-well auto-detect tool 805 be able to predict intermediate states which make compliance with this example policy possible.

Figure 9:
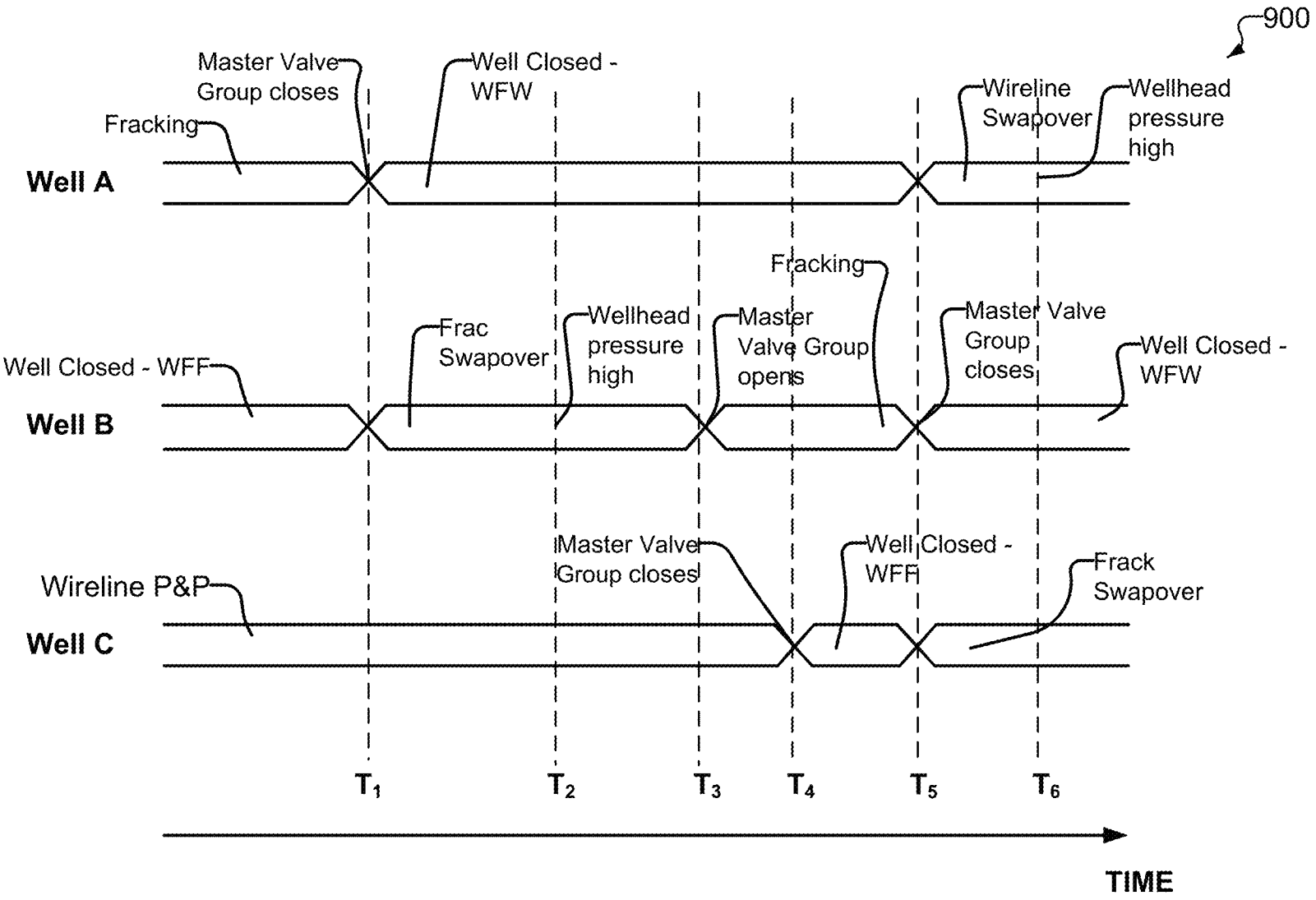
FIG. 9 is a timeline of well activity and events in a hypothetical fracking operation involving three wells.

FIG. 9 shows a timeline 900 of well activity and events in an example fracking operation involving three wells. As illustrated, at the start of timeline 900 (preceding $T_1$), Well A is being fracked, Well B is closed and is waiting to be fracked, and Well C is being prepared for its next fracking cycle by running the wireline plug & perf operation. At time $T_1$, fracking on Well A completes and the master valves 12 of the Well A master valve group are closed. The frac crew immediately begins to transition to Well B, as indicated by the Frac Swapover state. At time $T_2$, the rerouting of high pressure frac piping from Well A to Well B is complete and a pressure test starts in Well B, as detected by the wellhead pressure in Well B going high. At time $T_3$, the pressure test on Well B is complete and the master valves 12 of the Well B master valve group are opened to start fracking.

In the scenario where only single-well state-detection tools 305 are used, the Frac Swapover state for Well B would be identified as occurring over the time interval $T_2$ to $T_3$, which is when the high wellhead pressure is detected in Well B. However, a multi-well state-detection tool 805 would correctly identify the true time interval of the Frac Swapover event as being from $T_1$ to $T_3$, as the multi-well state-detection tool has knowledge that the Well A master valve group closes at time $T_1$, indicating that fracking has stopped in Well A and that Frac Swapover is commencing in Well B. This is an example of an inferred event—i.e. where information from Well A is used to infer the state of Well B. In some embodiments, when multi-well state-detection tool 805 determines that Well B changes to Frac Swapover, multi-well state-detection tool 805 accordingly instructs the Well B single-well state detection tool 305 to change to the Frac Swapover state, overriding the Well B state determination by its own single-well state-detection tool 305. Thus when the wellhead pressure rise is detected in Well B at $T_2$, the Well B single-well state-detection tool 305 might not report a change in state, as it will already be predicting that Well B is in the Frac Swapover state. Such an issue with single-well state-detection tool 305 could additionally or alternatively be addressed by including a new Frac Pressure Test state that could be detected when the pressure rise is detected at $T_2$.

Referring to Well C in FIG. 9, wireline operations are conducted on Well C until time $T_4$, when the master valves (valves 12A, 12B of the example FIG. 1 wellhead 10) of the Well C master valve group are closed, thus indicating the completion of wireline plug & perf activities. In this illustrative example, it is assumed that the above example operator policy is in place—i.e. that no personnel are allowed to approach the wellheads during fracking. Thus, the wireline crew is not permitted to approach the Well C wellhead to remove equipment and to start transitioning to Well A, which is waiting for its next wireline cycle, during the time between $T_4$ and $T_5$, due to active fracking on Well B. When Well B completes fracking at time $T_5$, detected by the closing of the valves 12 corresponding to its master valve group, the wireline crew is permitted to approach the Well C wellhead and start the transition of wireline piping to Well A.

As illustrated at time $T_5$, the well activity state of Well A changes to Wireline Swapover and the activity state of Well C changes to Frac Swapover. Even though the only primary event occurring at time $T_5$ is the closing of the valves 12 of the Well B Master Valve Group, multi-well state-detection toll 805 detector is able to inform the single-well state-detection tools 305 of Well A and Well C of these appropriate state changes. At time $T_6$, a high pressure is detected in the Well A wellhead with the valve(s) of the Well A swab valve group being in the open state. A single-well activity state-detection tool 305 would not detect the start of Wireline Swapover state in Well A until time $T_6$. However, using the multi-well state-detection tool 805, the algorithm is able to detect that the true start time of the Wireline Swapover state in Well A occurs at $T_5$ based on the detection of the closing of the valves 12 in the Well B master valve group.

As illustrated in the FIG. 9 example, the use of only single-well activity state-detection tools 305 may correctly detect the beginning and end of certain states, such as the start of the Fracking state in Well B (e.g. indicated by the valves of the Well B master valve group opening at $T_3$) and the end of Wireline P&P activities in Well C (e.g. indicated by valves of the Well C master valve group closing at $T_4$). However, as discussed, the use of only single-well activity state-detection tools 305 may not correctly detect the start of the swapover activities (e.g. Frac Swapover and Wireline Swapover). Accordingly, the use of a multi-well activity state-detection toll 805 is able to advantageously remedy the deficiencies of relying solely on single-well activity state detection tools 305. In other words, single-well state-detection tools 305 are able to base their state predictions on information (e.g. data) that is obtained from the sensors of their corresponding wells, whereas multi-well state-detection tools 805 (and corresponding multi-well state detection methods) may advantageously be able to base the state predictions of one well on data that is obtained from the sensors corresponding to one or more different wells.

FIG. 9 illustrates the use of an example multi-well state-detection tool 805 in a scenario where only a single well is fracked by a frac crew at a given point in time. However, this is not necessary and it is possible, in other scenarios and/or embodiments, that multi-well state-detection tools 805 may be provided to support other configurations and strategies, such as cases in which two wells are simultaneously fracked by a single frac crew. Operator specific configurations, such as the use of a dual-fracking strategy and/or the like, may be provided to multi-well state auto-detect tool 805 (such as through customization rules 330 in FIG. 3).

In practice, it may be desirable to detect and/or track the various states of the wells in a multi-well scenario with a greater state/activity resolution (e.g. with a larger number of possible states) than shown in the example of FIG. 9. By way of non-limiting example, the Frac Swapover state can be subdivided into Frac Swapover followed by Frac PressureTest. The general construction and implementation of auto-detect tools 305, 805 allows for the definition and detection of additional and/or alternative states than those shown and/or described herein.

Figure 9A:
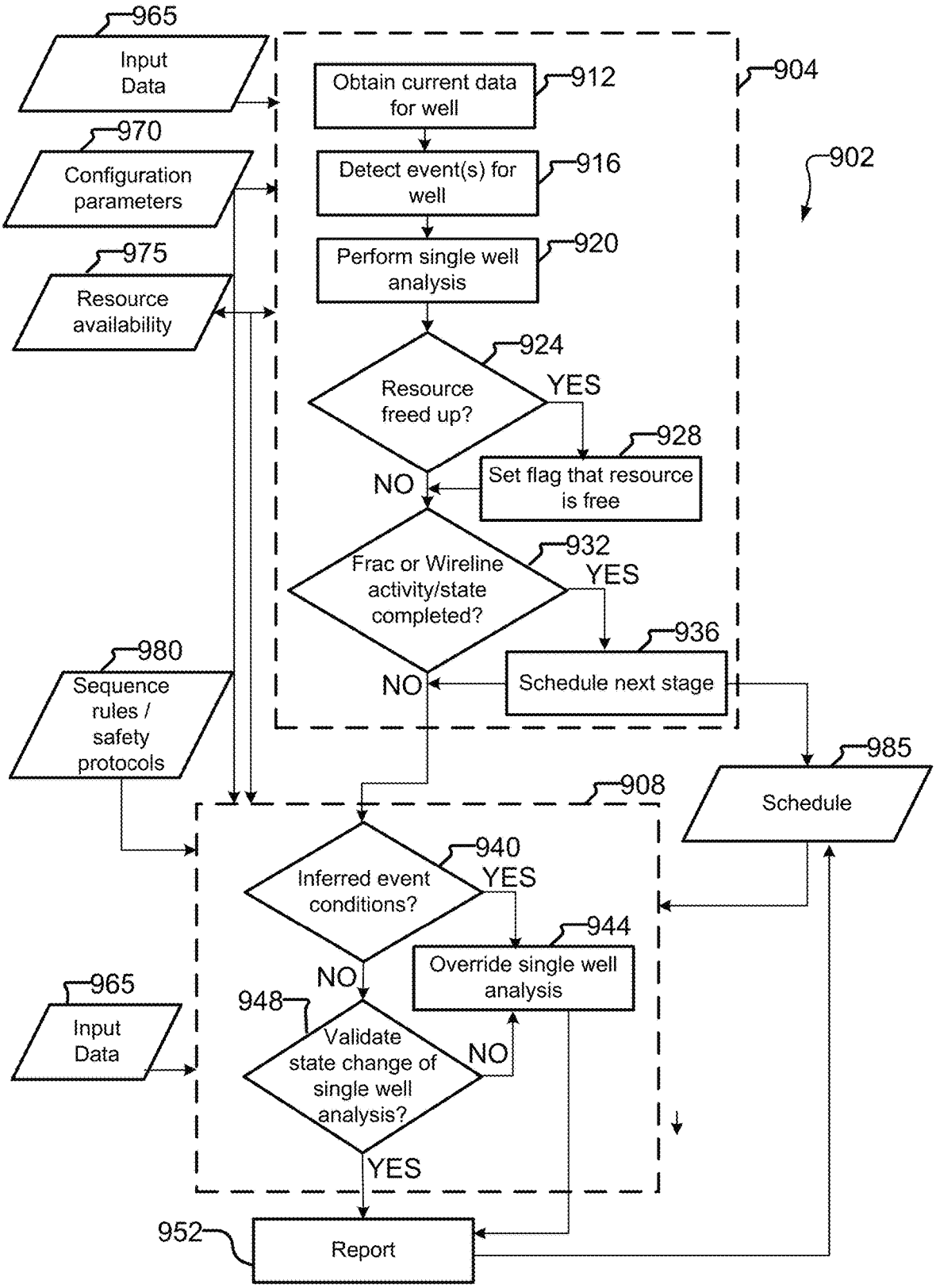
FIG. 9A shows a method for multi-well state detection according to a particular example embodiment.

FIG. 9A shows a method 902 for multi-well state detection according to a particular example embodiment. Method 902 may be performed by multi-well auto-detect tool 805 to detect the states of multiple wells in a multi-well system. FIG. 9 shows one iteration of method 902. In general, method 902 may be repeatedly executed with suitable time steps $\Delta_t$, where $\Delta_t$ may be on the order of 2 seconds or less.

Multi-well state detection method 902 of the illustrated embodiment can be divided into two separate procedures 904, 908, each of which is performed for every individual well in the multi-well system. Procedures 904, 908 may be performed sequentially in each iteration of method 902. That is, procedure 904 may be performed for each well and then procedure 908 may be performed for each well.

Procedure 904 starts in block 912 which comprises obtaining sensor data and/or all other relevant data for the well under consideration. Such block 912 data is shown in FIG. 9A by input data 965. Such block 912 data may include, by way of non-limiting example, any of the data shown in FIG. 3. From there, in block 916, procedure 904 involves detecting any event(s) that may have occurred (e.g. changes in the status of a valve group based on VPS data obtained in block 912; change in pressure state and/or the like). The types of events that may be detected in block 916 are described elsewhere herein. Then, in block 920, procedure 904 comprises performing the single well analysis. The single well analysis performed in block 920 may comprise the single well analysis described in method 500 (FIG. 5). The block 920 single well analysis 920 may be performed regardless of whether an event is detected in block 916, because the block 920 single well analysis 920 may enable the detection of soft events (e.g. well state changes due to time expiry and/or the like).

Procedure 904 then proceeds to block 924 which involves an inquiry as to whether any resources (e.g. the frac crew(s), the wireline crew(s) and/or the pump-down crew(s)) have freed up based on a state change predicted by the block 920 single well analysis. For example, if the block 920 single well analysis predicts that the Frac state has ended, then the block 924 inquiry would indicate that the frac crew is now free and available to move to the next well. A suitable flag may be set in block 928 to indicate that resource(s) have been determined to be free. The availability status 975 of the various available resources may be maintained by method 902. Procedure 904 then advances to block 932 which involves an inquiry as to whether the fracking or wireline state has just completed for the well under consideration. If the answer to the block 932 inquiry is positive, then procedure updates its schedule 985 in block 936. In updating schedule 985, block 936 may have access to some pre-configured scheduling information 970 which may be set, for example, by the operator of the multi-well system or the like. Such scheduling information 970 may comprise, by way of non-limiting example, a preferred well fracking order, whether to perform wireline operations just before or just after fracking, and/or the like.

Schedule 985 (illustrated in FIG. 9A) may represent the schedule for a variety of pending well operations. Schedule 985 may comprise separate sub-schedules for each frac crew (typically only one, but in some instances more than one), each wireline crew (often two or more) and potentially each pump-down crew (if the pump-down crew is different from the wireline crew). Each sub-schedule in schedule 985 may be maintained as a suitable queue or list where the "top" of the list indicates the next well to be serviced. Each sub-schedule in schedule 985 could be maintained as a circular list in which only the pointer changes.

As part of block 952, when it is determined that a frac operation has started on a particular well, then that particular well may be removed from the frac crew sub-schedule. Where there are multiple frac crews that can service that well, then that well may be removed from the sub-schedule for each frac crew. When the block 932 inquiry determines that a frac operation has completed on a particular well, then that well may be re-added (e.g. to the bottom) of the frac crew sub-schedule. Where there are multiple frac crews that can service that well, then that well may be re-added (e.g. to the bottom) of the sub-schedule for each frac crew. It is not strictly necessary that the well be added to the bottom of a sub-schedule. In some implementations, configuration parameters 970 (provided by the operator of the wellsite) may dictate other scheduling parameters, which may dictate that the well for which fracking just completed be re-added to another location in the corresponding sub-schedule(s).

Similarly, as part of block 952, when it is determined that a wireline operation has started on a particular well, then that particular well may be removed from the wireline crew sub-schedule. Where there are multiple wireline crews that can service that well, then that well may be removed from the sub-schedule for each wireline crew. When the block 932 inquiry determines that a wireline operation has completed on a particular well, then that well may be re-added (e.g. to the bottom) of the wireline crew sub-schedule. Where there are multiple wireline crews that can service that well, then that well may be re-added (e.g. to the bottom) of the sub-schedule for each wireline crew. Just as is the case for the frac sub-schedule discussed above, it is not strictly necessary that the well be added to the bottom of a wireline sub-schedule and configuration parameters 970 may dictate that the well be re-added to another location in the corresponding sub-schedules. Where the pump-down crew is different from the wireline crew, then the pump-down crew sub-schedule can be maintained in a manner similar to that of the wireline crew discussed above.

Once procedure 904 has been performed for all wells in the system, method 902 then advances to procedure 908. As mentioned above, procedure 908 is performed for each well. Procedure 908 starts in block 940 which involves an inquiry into whether an event and/or state change in the well currently under consideration can be inferred based at least in part on events, changes in state and/or sensor data relating to another well. The block 940 inquiry may make use of any of input data 965, configuration/scheduling parameters 970, resource availability data 975, operator-defined sequence rules and/or safety protocols 980 and/or schedule 985. An example of a operator-defined safety protocol may be that a wireline crew may be ready to transition to the next well, but, due to active fracking and associated high pressures on an adjacent well, the wireline crew not permitted to approach the wellhead until such time as fracking has concluded or paused and the pressure in surface piping is reduced to safe levels. If the block 940 inquiry is positive (that is the state of the well currently being evaluated can be inferred based at least in part on events, changes in state and/or sensor data relating to another well, then method proceeds to block 944, where the state predicted by the block 920 single well analysis of the well currently under consideration is updated with (i.e. overridden by) the inferred state.

On the other hand, if the block 940 inquiry is negative, then procedure 908 advances the block 948, which involves a validation inquiry into whether any state change advocated by the block 920 single well analysis corresponding to the well currently under consideration is valid. This block 948 validation of any advocated state change may be based on any combination of the available data including, by way of non-limiting example, input data 965 for the well under consideration and or for any other well in the system, configuration parameters 970, resource availability 975, sequence rules and safety protocols 980 and/or the state(s) advocated by block 920 for any other wells in the system. If the block 948 validation query is negative, then procedure 908 proceeds to block 944 where the block 920 state change prediction is overridden. In some embodiments, if procedure 908 enters block 944 from block 948 (i.e. because a block 920 state change prediction is invalidated), then block 944 may involve overriding the block 920 state change prediction with the current (unchanged) state of the well under consideration. Additionally or alternatively, if procedure 908 enters block 944 from block 948 (i.e. because a block 920 state change prediction is invalidated), then block 944 may involve soliciting human feedback (e.g. user confirmation/adjustment 345 (FIG. 3)).

Once procedures 904 and 908 are performed for all wells in the multi-well system, the well state predictions are reported for all wells in block 952.

In some circumstances (not shown in FIG. 9A), method 902 may predict a state that is later overridden by a user (e.g. user confirmation/adjustment 345 (FIG. 3)), then method 902 may be re-applied for the iteration in which the error is detected and any or all subsequent iterations. In such cases, the iteration interval $\Delta_t$ may be effectively set to zero and the steps of method 902 may be implemented using recorded time instead of real time. In such circumstances, the block 920 single well analysis may report a time offset (rather than a real time) for detected state change. This accommodates the situation in which a timer in the block 920 single well analysis can expire between events detected from sensor data 965. In some embodiments, after such a user override, it may be desirable to "replay" method 900 using recorded data in the same sequence as if the algorithm were running live.

The fracking sequence of multiple wells on a multi-well site (represented by operator sequence rules 980 and/or configuration parameters 970) often does not remain constant throughout a completions operation, either by design or on an adhoc basis to deal with unplanned situations. When such a change occurs, schedule 985 may be updated to reflect the change in sequence. Also, method 902 may be re-applied to recorded (i.e. historical or past) sensor events/state changes, followed by resumption of live operation of multi-well state detection method 902.

Pressure Leak Detection

In scenarios where pressure is measured at a particular location in a well system and all of the valves 12 surrounding that location are closed, it is expected that the pressure within that contained location remains constant. In the case that a valve 12 is leaking or begins to leak, the pressure within that monitored location may increase or decrease. Thus, some embodiments of the present invention comprise methods for indicating a potential valve leak upon the detection of a change in pressure. Such methods may be implemented, for example, by the auto-detection tools described herein and/or by the same suitably programmed computers/processors/controllers and/or the like 306 that are configured to provide such auto-detection tools 305, 805.

Figure 10:
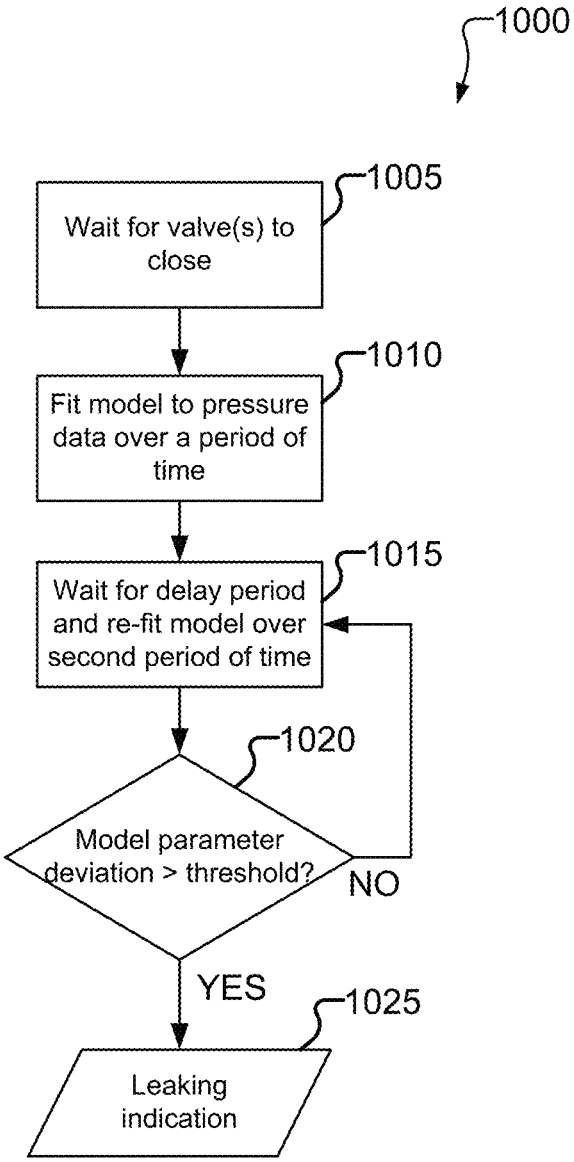
FIG. 10 is a block diagram of an example method for detecting a potential valve leak according to a particular example embodiment.

FIG. 10 is a block diagram of a method 1000 for detecting a potential valve leak according to a particular embodiment. Method 1000 applies to the scenario of monitoring a pressure sensor 16 or a group of pressure sensors 16 at a particular location at a wellhead. At block 1005, method 1000 comprises detecting that one or more valves 12 have closed, at which point the corresponding pressure sensor(s) 16 are expected to be isolated from the external pressure effects and to report generally constant pressure. Upon detecting that the appropriate valve(s) 12 have been closed, method 1000 proceeds to block 1010 which comprises monitoring pressure data from the corresponding pressure sensor(s) 16 over a period of time and then fitting that data to a suitable curve model (e.g. to a straight line model y=mx+b). Block 1010 involves obtaining the parameters of the model based on the measured pressure data. If the corresponding valve(s) 12 are working properly and the model being fit in block 1010 is the straight line model y=mx+b, then it would be expected that there is minimal change in pressure over the block 1010 measurement period and that the slope of the measured pressure (e.g. the parameter m in the model) would be 0.

After initially fitting the pressure data to a model in block 1010, method 1000 proceeds to block 1015 where, after a configurable delay period has passed, pressure data from pressure sensor(s) 16 is monitored over a second period of time and is once again fit to a suitable curve model. The model used in block 1015 is the same as the model used in block 1010. Block 1015 involves obtaining the parameters of the model based on the measured pressure data. Method 1000 then proceeds to evaluation block 1020 which involves comparing one or more of the block 1015 model parameters to one or more of the block 1010 model parameters. If the change in the model parameters between blocks 1010 and 1015 is greater than a configurable threshold (block 1020 YES branch), then method 1000 reports an indication 1025 of a leaking valve. If the change in the model parameters between blocks 1010 and 1015 is less than the configurable threshold (block 1020 NO branch), then method 1000 returns to block 1015. For the case where the model is the straight line model y=mx+b, the parameter evaluated in block 1020 may be the slope parameter m. In some embodiments, for each iteration of block 1015 after the first iteration, the block 1020 evaluation may be based on a comparison of the model parameters from the two most recent iterations of block 1015 or based on a comparison of the model parameters from the most recent iteration of block 1015 and an average of previous iterations of block 1010 and 1015.

In some embodiments, valve leak detection method 1000 may be used as part of any well activity state auto-detect tool 305, 805 or method described herein. In some embodiments, valve leak detection method 1000 can additionally consider the known wellhead and/or sensor topology and be able to access measured pressure(s) in other location(s) of the wellhead system. In these circumstances, valve leak detection method 1000 may be able to identify which of the enclosing valves 12 is likely to be leaking.

Figure 11:
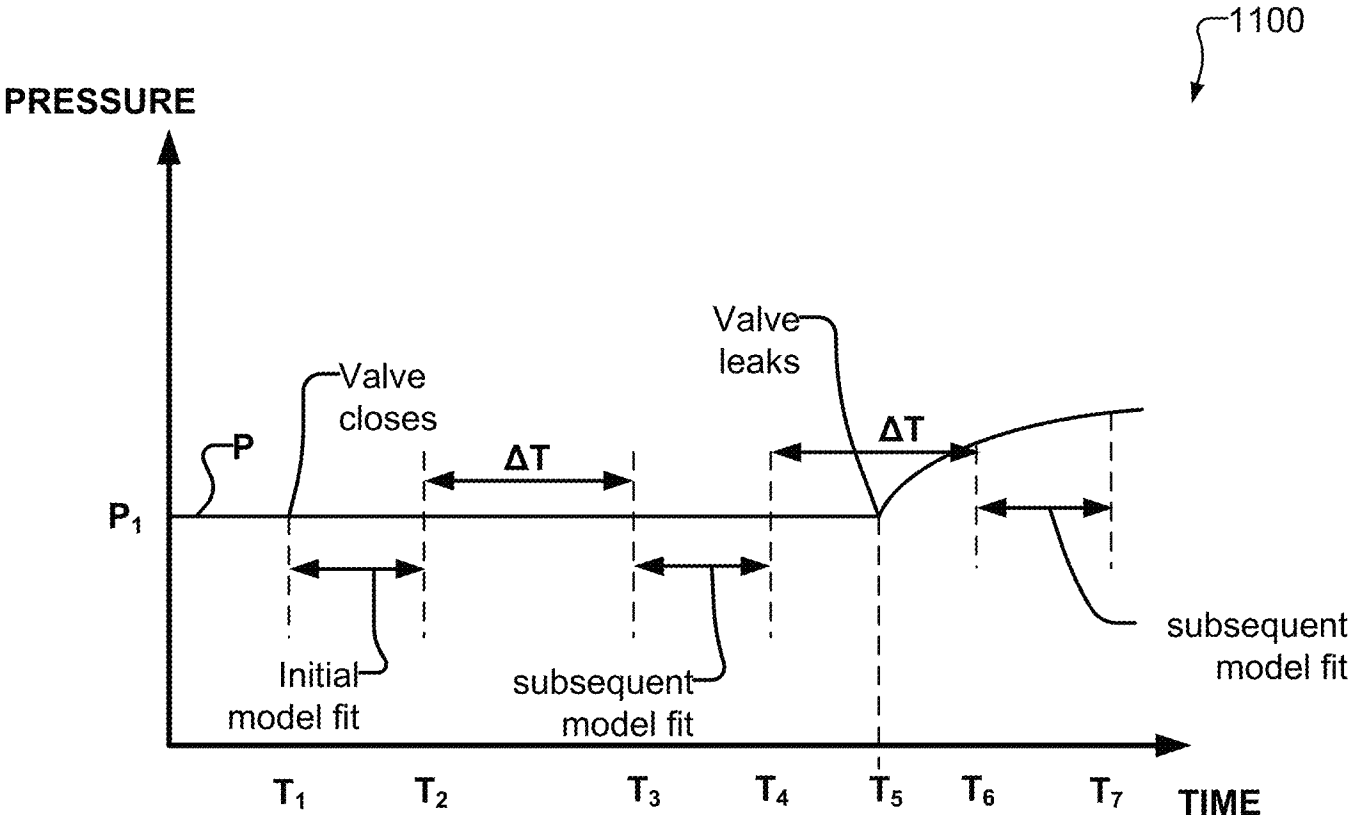
FIG. 11 depicts a plot of pressure measured in an enclosed area over time and indicating a valve leak.

FIG. 11 depicts an exemplary plot 1100 of pressure measured in an enclosed well location over time. Plot 1100 illustrates a number of principles described in method 1000 (FIG. 10). As shown in FIG. 11, a pressure P represents a pressure measurement in a region of a wellhead enclosed by one or more valves 12. At time $T_1$, a valve 12 closes to isolate the pressure within the monitored location. Between $T_1$ and $T_2$, an initial set of pressure samples is collected and a straight line model, y=mx+b, is fitted to the data. The fitted model has parameters m=0, b=$P_1$. The fitting of the straight line model, y=mx+b, and the determining of the model parameters m and b may be illustrative of block 1010 of method 1000. After the passage of a delay period $\Delta T$ (e.g. from $T_2$ to $T_3$), pressure measurements are taken between $T_3$ and $T_4$ to once again fit the straight line model, y=mx+b, and to determine the model parameters (which again, in the case of the FIG. 11 example, evaluate to m=0, b=$P_1$). This second curve fitting represents block 1015 of method 1000. When the model parameters (e.g. the slope parameter m) of the curve fitting between ($T_1$, $T_2$) and the curve fitting between ($T_3$, $T_4$) are compared, there is no difference. This comparison represents block 1020 and the lack of difference in the model parameters represents the block 1020 NO branch.

Following the delay period $\Delta T$ from times $T_4$, to $T_6$, the model fitting process is once again repeated between times $T_6$ and $T_7$. However, at an intervening time $T_5$, a valve leak occurs. Thus, when the model curve is fit again in the time between $T_6$ and $T_7$, the slope parameter m is notably positive. Upon a re-evaluation of block 1020, the difference in the slope parameters m represents strong evidence that at least one of the valves 12 enclosing the pressure sensing location is leaking.

Advantageously, the curve fitting approach (over time) of pressure leak detection method 1000 mitigates the occurrence of false positive events caused by minor pressure fluctuations. Further, the use of fitted curves (as opposed over averages) over time advantageously takes advantage of all data measured during the time period. The requirements and thresholds for triggering a valve leak warning can be configurable and may be based on a number of different factors. As an illustrative example, the minimum magnitude change in the detected pressure and/or in the fitted slope required to trigger a warning may be determined as a function of the pressure sampling duration, the data sample rate, and the sampling noise. These parameters are configurable based on criteria of a specific operator or of the fracking operation. For example, smaller thresholds can provide increased sensitivity. However, this often comes at the cost of an increased rate of false positive results (i.e. an erroneous indication that a leak is occurring). For a given sensitivity, the false positive rate can be reduced by increasing the pressure sampling duration, when fitting a data model (e.g. at blocks 1010 and 1015).

Pressure Decay Analysis & Perturbation Detection Algorithm

After a well has been fracked and the valves 12 of the wellhead are closed, the pressure trapped in the wellbore (and wellhead too if the master valves 12 remain open) slowly decays towards an asymptotic limit. The value of the asymptotic limit is dependent on physical characteristics of the recently fracked zone. Typically, the asymptotic pressure limit has a positive value. The characteristic pressure decay can be described by an exponential equation in the following form:

$$P=Po+k^{*}\exp(-rt) \quad (4)$$

where Po is the asymptotic pressure limit, r>0 is the rate of decay, k is a scalar decay constant, and t is time.

Figure 12A:
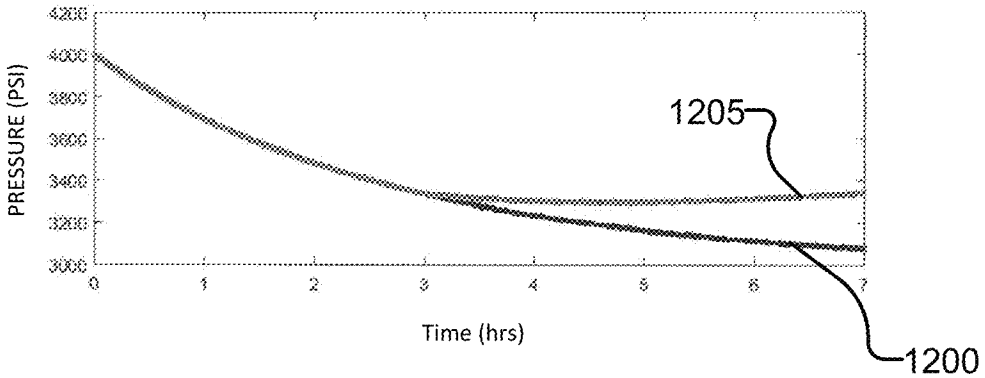
FIG. 12A depicts a plot of pressure over time showing two pressure profiles having different decay constants.

FIG. 12A depicts a plot 1200 of measured pressure over time. Plot 1200 illustrates a typical pressure profile of decaying pressure where the pressure is dropping and approaching an asymptotic limit. This is the scenario when k>0 in equation (4). When k<0 in equation (4), the pressure will increase toward an asymptotic limit. FIG. 12A also depicts a plot 1205 of a pressure profile that is perturbed (e.g. by pressure leakage from a neighboring well that is being fracked). It can be see that pressure profile 1205 is no longer trending to the original asymptotic limit.

Figure 12B:
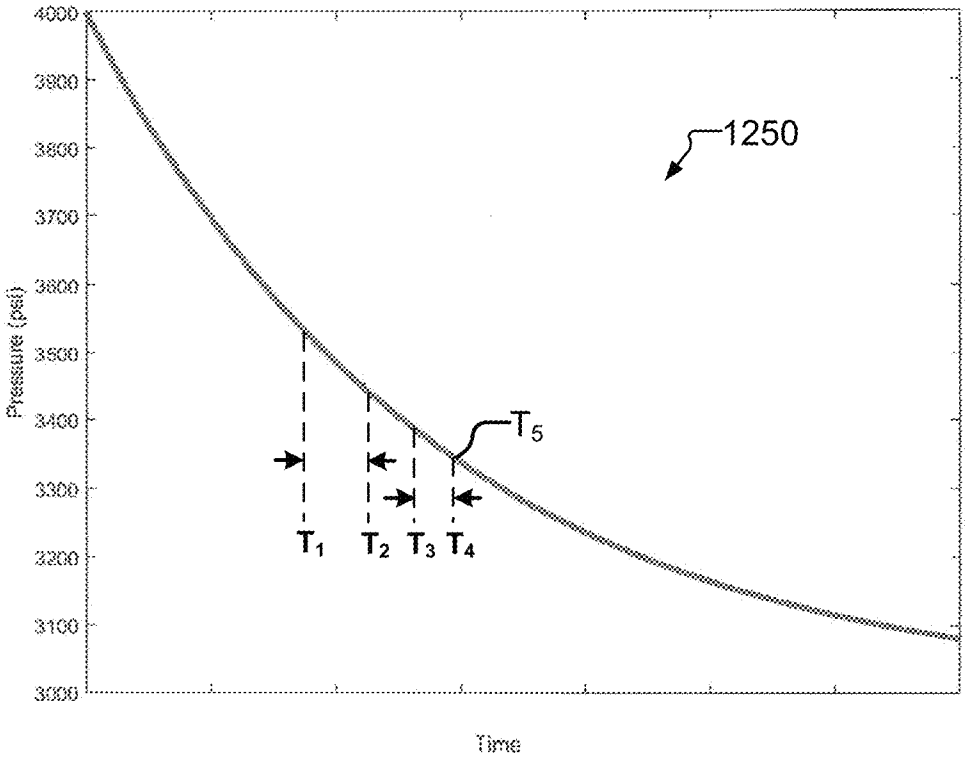
FIG. 12B depicts a plot of asymptotically decaying pressure through which a data model can be developed.
Figure 13:
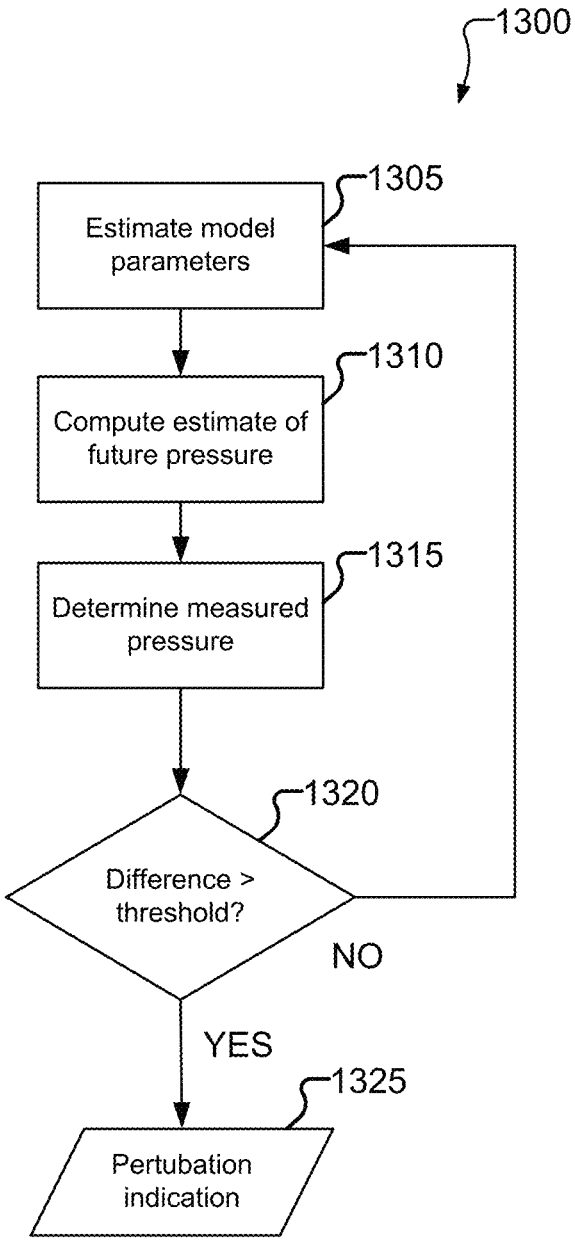
FIG. 13 is a block diagram of an example method for detecting a potential pressure perturbation according to a particular embodiment.

Some embodiments of the present invention comprise detecting when a pressure decay trend is perturbed. For example, a pressure decay trend may be perturbed due to a leaking valve 12, or where there is unexpected pressure "communication" from a neighboring well that is being fracked, FIG. 13 shows a block diagram of a method 1300 for detecting a potential pressure perturbation (e.g. due to a leaking valve or communication from a neighboring well that is being fracked) according to a particular example embodiment. Method 1300 may be implemented, for example, by the auto-detection tools described herein and/or by the same suitably programmed computers/processors/controllers and/or the like 306 that are configured to provide such auto-detection tools 305, 805. Certain aspects of method 1300 are illustrated using FIG. 12B, which depicts a plot 1250 of an asymptotically decaying pressure. Method 1300 begins at block 1305 which comprises estimating a first set of model parameters based on pressure measurements (obtained from pressure sensors 16) during a first time window. The model which is fit to the pressure measurement data in block 1305 (e.g. in a curve fitting or optimization process) may be an exponential model such as that of equation (4). The equation (4) model parameters obtained in block 1305 may comprise the parameters $P_o$, k and r. FIG. 12B shows an example time window (between times $T_1$ and $T_2$) during which pressure measurements can be obtained to obtain the model parameters is block 1305. Using the block 1305 model parameters, block 1310 comprises computing an estimate of the pressure at some future time. With reference to FIG. 12B, the pressure at time $T_5$ may be estimated using the block 1305 model parameters in accordance with equation (4) or some other suitable model.

Block 1315 comprises measuring the pressure at the time of the block 1310 pressure estimate (e.g. at $T_5$). In some embodiments, measuring the pressure in block 1315 comprises obtaining pressure data during a second time window (e.g. between $T_3$ and $T_4$). In some such embodiments, the second time window ($T_3$ to $T_4$) encompasses the time $T_5$ corresponding to the block 1310 pressure estimate. In some embodiments, as is the case in the illustrated embodiment, $T_4=T_5$ and represents the most recent pressure data sample. As shown in FIG. 12B, the second time window comprises the time between times $T_3$ and $T_4$ and which encompasses time $T_5$. In some embodiments, block 1315 comprises determining a set of model parameters (using a curve fitting or optimization process similar to that of block 1305) based on pressure measurements obtained in the second time window ($T_3$ to $T_4$), which model parameters are then used to determine the pressure value at time $T_5$. The second time window (e.g. between times $T_3$ and $T_4$) may be selected to be only as large as is desirable to mitigate against noise in the pressure measurement process. In some embodiments, times $T_3=T_4=T_5$, and the block 1315 pressure at time $T_5$ is instantaneous pressure measured at time $T_5$.

Method 1300 then proceeds to decision block 1320 which comprises evaluating whether the difference between the pressure measured or otherwise determined in block 1315 and the estimated pressure determined in block 1310 is greater than a configurable threshold amount. If the block 1320 determination is positive, then method 1300 indicates a potential perturbation 1325 to the expected pressure decay process. Where the determination at block 1320 is negative, method 1300 may return to block 1305 to continue monitoring for perturbations. Method 1300 may be continually repeated until it is no longer desirable to detect pressure perturbation events.

As a non-limiting example of example time scales in method 1300 and FIG. 12B, the first (block 1305) time window (e.g. between times $T_1$ and $T_2$) may be in the range of about 2-30 minutes (e.g. 15 minutes). The second (block 1315) time window (e.g. between times $T_3$ and $T_4$) may be in the range of about 1-10 minutes (e.g. 5 minutes). The time elapsed between the first (block 1305) and second (block 1315) time windows may be in the range of about 5-120 seconds (e.g. 30 seconds).

FIG. 12B only illustrates an example of a possible pressure profile. It will be appreciated that method 1300 can be performed using any number of possible pressure profiles. Furthermore, the exponential model of equation (4) represents only one possible model. In some embodiments, the model used for method 1300 may comprise a linear model, among other possibilities. In some embodiments, modelling the pressure profile as a linear model in method 1300 may be preferred for its simplicity and tolerance to extrapolation errors, caused by the fact that the pressure perturbation time scale may be quite large.

Advantageously, the curve fitting approach (over time) of pressure perturbation detection method 1300 mitigates the occurrence of false positive events caused by minor pressure fluctuations. Further, the use of fitted curves (as opposed over averages) over time advantageously takes advantage of all data measured during the time period.

Figure 12C:
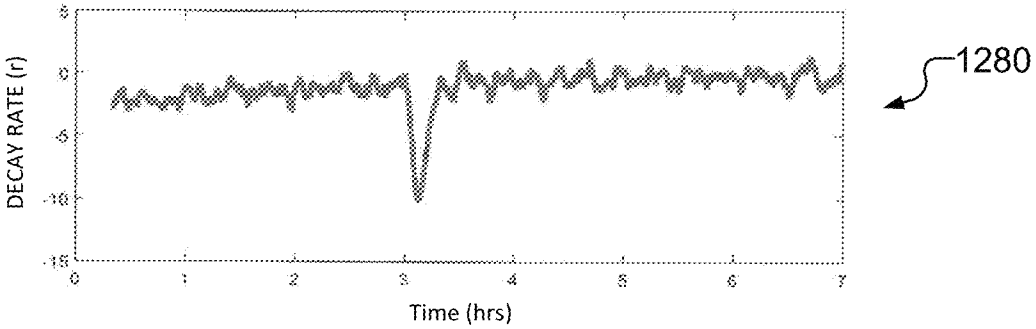
FIG. 12C shows a plot of an exemplary perturbation detection.

FIG. 12C depicts a plot 1280 of an exemplary perturbation detection. As illustrated, prior to time t=3 hrs, the pressure is decaying at a constant decay rate (i.e. parameter r in equation (4)). At time t=3 hrs, a valve starts to leak (for example, e, due to a higher external pressure) and the constant rate of pressure decay is perturbed. The perturbation detection algorithm (e.g. method 1300) is able to clearly identify a change in the decay trend immediately after the start of the perturbation and can provide an appropriate indication. Following this event and beyond the time at which the perturbation ends, the algorithm is able to continue tracking the new observed trend (e.g. at around T=3.5 hours in plot 1280).

Interpretation of Terms

Unless the context clearly requires otherwise, throughout the description and the

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof; elements which are integrally formed may be considered to be connected or coupled;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list; and
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs")). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a computer system for a device may implement methods as described herein by executing software instructions in a program memory accessible to the processors.

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Embodiments of the invention may also be provided in the form of a program product. The program product may comprise any non-transitory medium which carries a set of computer-readable instructions which, when executed by a data processor, cause the data processor to execute a method of the invention. Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g. EEPROM semiconductor chips), nanotechnology memory, or the like. The computer-readable signals on the program product may optionally be compressed or encrypted.

In some embodiments, the invention may be implemented in software. For greater clarity, "software" includes any instructions executed on a processor, and may include (but is not limited to) firmware, resident software, microcode, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Where a record, field, entry, and/or other element of a database is referred to above, unless otherwise indicated, such reference should be interpreted as including a plurality of records, fields, entries, and/or other elements, as appropriate. Such reference should also be interpreted as including a portion of one or more records, fields, entries, and/or other elements, as appropriate. For example, a plurality of "physical" records in a database (i.e. records encoded in the database's structure) may be regarded as one "logical" record for the purpose of the description above and the claims below, even if the plurality of physical records includes information which is excluded from the logical record.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A method for determining an operational state of a well in a completion operation, the method comprising:

receiving a set of well operations data, the received data comprising at least some measured well operations data;

wherein receiving the set of data comprises receiving measured valve position data from one or more valve position sensors, each valve position sensor measuring a position of a corresponding valve;

determining the occurrence of a well operations event based on the received data;

after determining the occurrence of the event, evaluating one or more possible state transitions from a current well operations state to one or more possible new well operations states, the current state and the possible new states selected from a configurable plurality of well operations states, wherein evaluating the one or more possible state transitions is based on the current state, the determined event and the received data and wherein evaluating the one or more possible state transitions comprises determining a confidence level associated with each of the possible new states; and determining one of the possible new states to be a new predicted well operations state according to whichever possible new state has a highest confidence level.

2. The method of claim 1 wherein evaluating the one or more possible state transitions comprises selecting the one or more possible new states from among the plurality of well operations states based on the current state.

3. The method of claim 1 wherein determining the occurrence of the event based on the received data comprises determining from at least one of the one or more valve position sensors that its corresponding valve has transitioned from open to closed or from closed to open.

4. The method of claim 1 wherein determining the occurrence of the event based on the received data comprises determining from at least one of the one or more valve position sensors that its corresponding valve is being greased.

5. The method of claim 1 wherein evaluating the one or more possible state transitions from the current state to the one or more possible new states is based at least in part on the measured valve position data.

6. The method of claim 1 wherein receiving the set of data further comprises receiving measured pressure data from one or more pressure sensors, each pressure sensor measuring pressure in a corresponding region of the well.

7. The method of claim 6 wherein determining the occurrence of the event based on the received data comprises determining that the pressure measured by at least one of the one or more pressure sensors has crossed from above a configurable threshold to below the configurable threshold or from below the configurable threshold to above the configurable threshold.

8. The method of claim 6 wherein evaluating the one or more possible state transitions from the current state to the one or more possible new states is based at least in part on the measured pressure data.

9. The method of claim 6 wherein evaluating the one or more possible state transitions comprises:

grouping the one or more valves into valve groups, each valve group comprising one or more valves and associated with one or more corresponding valve position sensors;

grouping the one or more pressure sensors into pressure sensor groups, each pressure sensor group comprising one or more pressure sensors;

constructing a vector, with entries for each valve group based on the measured valve position data from its associated valve position sensors and for each pressure sensor group based on measured pressure sensor data from its associated pressure sensors;

comparing the constructed vector with each row of a secondary analysis matrix, each row of the secondary analysis matrix corresponding to one of the configurable plurality of states and each column of the secondary analysis matrix corresponding to one of the valve groups or one of the pressure sensor groups, wherein each element of the secondary analysis matrix comprises an assigned numerical value based on an expected state of that valve group or that pressure sensor group for that one of the configurable plurality of states;

assigning a ranking to the configurable plurality of states based on the comparing of the constructed vector with each row of the secondary analysis matrix.

10. The method of claim 6 wherein evaluating the one or more possible state transitions comprises:

grouping the one or more valves into valve groups, each valve group comprising one or more valves and associated with one or more corresponding valve position sensors;

grouping the one or more pressure sensors into pressure sensor groups, each pressure sensor group comprising one or more pressure sensors;

assigning numerical valves to each valve group based on the measured valve position data from its associated valve position sensors and to each pressure sensor group based on the measured pressure data from its associated pressure sensors;

constructing a vector, with entries for each valve group based on the assigned numerical value for that valve group and for each pressure sensor group based on assigned numerical value for that pressure sensor group;

determining a difference metric between the constructed vector and each row of a secondary analysis matrix, each row of the secondary analysis matrix corresponding to one of the configurable plurality of states and each column of the secondary analysis matrix corresponding to one of the valve groups or one of the pressure sensor groups, wherein each element of the secondary analysis matrix comprises an assigned numerical value based on an expected state of that valve group or pressure sensor group for that one of the configurable plurality of states; and assigning a ranking to the configurable plurality of states based on the difference metrics.

11. The method of claim 1 wherein receiving the set of data further comprises receiving third party data and wherein evaluating the one or more possible state transitions from the current state to the one or more possible new states is based at least in part on the third party data.

12. The method of claim 1 wherein the configurable plurality of states comprises:

well shut in—waiting for wireline;

well shut in—waiting for frac;

wireline swapover;

wirelines plug and perforate;

frac swapover; and frac.

13. The method of claim 1 wherein determining the occurrence of the event comprises one or more of:

determining that a flow rate from a frac pumping provider has crossed a configurable frac-pump threshold;

determining that a flow rate from a pump down pumping provider has crossed a configurable pump-down threshold;

determining that a proppant concentration has crossed a configurable proppant-concentration threshold; and determining that a total cumulative amount of proppant for a current completion stage has crossed a configurable proppant-volume threshold.

14. The method of claim 1 wherein determining the occurrence of the event comprises determining that the current state has been unchanged for more than a configurable time threshold.

15. The method of claim 1 wherein determining the confidence level associated with each of the possible new states comprises, for each of the possible new states, assigning the possible new state a confidence level selected from among a plurality of possible confidence levels.

16. The method of claim 1 wherein evaluating the one or more possible state transitions comprises:

selecting the one or more possible new states from among the plurality of well operations states based on the current state and the determined event;

for each of the one or more possible new states:

using the received data to evaluate one or more configurable conditions; and if the one or more configurable conditions are met, assigning a corresponding confidence level to the possible new state.

17. The method of claim 1 wherein evaluating the one or more possible state transitions comprises:

grouping the one or more valves into valve groups, each valve group comprising one or more valves and associated with one or more corresponding valve position sensors;

constructing a vector, with entries for each valve group based on the measured valve position data from its associated valve position sensors;

comparing the constructed vector with each row of a secondary analysis matrix, each row of the secondary analysis matrix corresponding to one of the configurable plurality of states and each column of the secondary analysis matrix corresponding to one of the valve groups, wherein each element of the secondary analysis matrix comprises an assigned numerical value based on an expected state of that valve group for that one of the configurable plurality of states;

assigning a ranking to the configurable plurality of states based on the comparing of the constructed vector with each row of the secondary analysis matrix.

18. The method of claim 1 wherein evaluating the one or more possible state transitions comprises:

grouping the one or more valves into valve groups, each valve group comprising one or more valves and associated with one or more corresponding valve position sensors;

assigning numerical valves to each valve group based on the measured valve position data from its associated valve position sensors;

constructing a vector, with entries for each valve group corresponding the assigned numerical value for that valve group;

determining a difference metric between the constructed vector and each row of a secondary analysis matrix, each row of the secondary analysis matrix corresponding to one of the configurable plurality of states and each column of the secondary analysis matrix corresponding to one of the valve groups, wherein each element of the secondary analysis matrix comprises an assigned numerical value based on an expected state of that valve group for that one of the configurable plurality of states; and assigning a ranking to the configurable plurality of states based on the difference metrics.

19. A method for determining operational states of a plurality of wells of a wellsite in a multi-well completion operation, the method comprising:

performing a single well state prediction method for each of the plurality of wells to thereby predict an initial well operations state for each of the plurality of wells, the single well state prediction method comprising the method of claim 1;

after performing the single well state prediction method for all of the plurality of wells, for each of the plurality of wells:

determining whether the predicted initial state of the well should be replaced with an updated well operations state prediction;

if the determination determines that the predicted initial state of the well should be replaced with an updated state prediction, then replacing the predicted initial state of the well with the updated state prediction.

20. The method of claim 19 wherein, for each of the plurality of wells, determining whether the predicted initial state of the well should be replaced with the updated state prediction comprises inferring the updated state prediction based at least in part on one or more of: current states of one or more other wells from among the plurality of wells; determined events of the one or more other wells from among the plurality of wells; received data of the one or more other wells from among the plurality of wells; and measured data of the one or more other wells from among the plurality of wells.

21. The method of claim 19 wherein performing the single well state prediction method for each of the plurality of wells comprises determining that a resource associated with the wellsite is free and wherein, for each of the plurality of wells, determining whether the predicted initial state of the well should be replaced with the updated state prediction comprises inferring the updated state prediction based at least in part on the determination that the resource is free.

22. The method of claim 19 wherein performing the single well state prediction method for each of the plurality of wells comprises determining that a frac or wireline operation of one of the wells has completed and updating a corresponding schedule and wherein, for each of the plurality of wells, determining whether the predicted initial state of the well should be replaced with the updated state prediction comprises inferring the updated state prediction based at least in part on the updated schedule.

23. The method of claim 19 comprising, after performing the single well state prediction method for all of the plurality of wells, validating the initial well operations state for each of the plurality of wells based on one or more of:

current states of the plurality of wells;

determined events of the plurality of wells; and received data of the plurality of wells.

* * * * *